United States Patent [19]

Wirtschafter et al.

[11] Patent Number: 4,588,303

[45] Date of Patent: May 13, 1986

[54] MEDICAL TIMER APPARATUS

[75] Inventors: Jonathan D. Wirtschafter, Minneapolis, Minn.; Richard S. Walton, Tempe, Ariz.

[73] Assignee: Mediminder Development Limited Partnership, Minneapolis, Minn.

[21] Appl. No.: 624,931

[22] Filed: Jun. 25, 1984

[51] Int. Cl.[4] ..... G04B 47/00

[52] U.S. Cl. ..... 368/10; 368/109

[58] Field of Search ..... 368/10, 12, 97, 98, 368/109; 340/390.1, 390.4; 215/DIG. 3; 221/2

[56] References Cited

U.S. PATENT DOCUMENTS 4,419,016 12/1983 Zoltan ..... 368/10

4,490,711 12/1984 Johnston ..... 368/10

*Primary Examiner*—Bernard Roskoski

*Attorney, Agent, or Firm*—Henderson & Sturm

[57] ABSTRACT

A medical timer apparatus that provides a time of day display and that measures time as between sensings of a monitored parameter, such as the opening of a medication container. Alarm time information may be input as either preselected times of day or as an interval between openings of the medication container. A minimum safe interval between dosages unit operates to signal when medication should not be taken. A predosing interval unit operates to signal the operator that medication might be safely dispensed even though the alarm time has not yet arrived. The invention also operates to calculate and display a compliance score that indicates how well the patient has complied wtih the prescription schedule.

16 Claims, 32 Drawing Figures

Microfiche Appendix Included (17 Microfiche, 1 Pages)

16
DUAL MODE ALARM SET UNIT 10
18
PREDOSING INTERVAL UNIT
MIN. SAFE INTERVAL BETWEEN DOSAGES UNIT
17
23
ALARM UNIT
SQUELCH UNIT
13
22
ELAPSED TIME MEASUREMENT UNIT
TIME OF DAY CLOCK UNIT
DISPLAY UNIT
12
11
COMPLIANCE SENSING UNIT
14
CHECK ELAPSED TIME WARNING UNIT
19
21
COMPLIANCE SCORE UNIT 1 (FIG.4a)
2 (FIG.4a)

B=1
NO
UPDATE TIME
YES
6 ALARM TIMES SET ?
YES
REVIEW ALARM TIMES
GOTO "READ K SWITCHES"
NO
NO
SET INTERVAL MODE ?
YES

1 SEC. UPDATE ?
NO
YES
UPDATE TIME
INCREMENT DISPLAY
NO
B=1
YES
INSERT DISPLAYED TIME IN REGISTER
SET BLANKING FLAGS
NO
1 SEC UPDATE ?
UPDATE TIME
DISPLAY BLANK
NO
YES
UNBLANK DISPLAYS
BLANK DISPLAYS
YES
B=0
NO

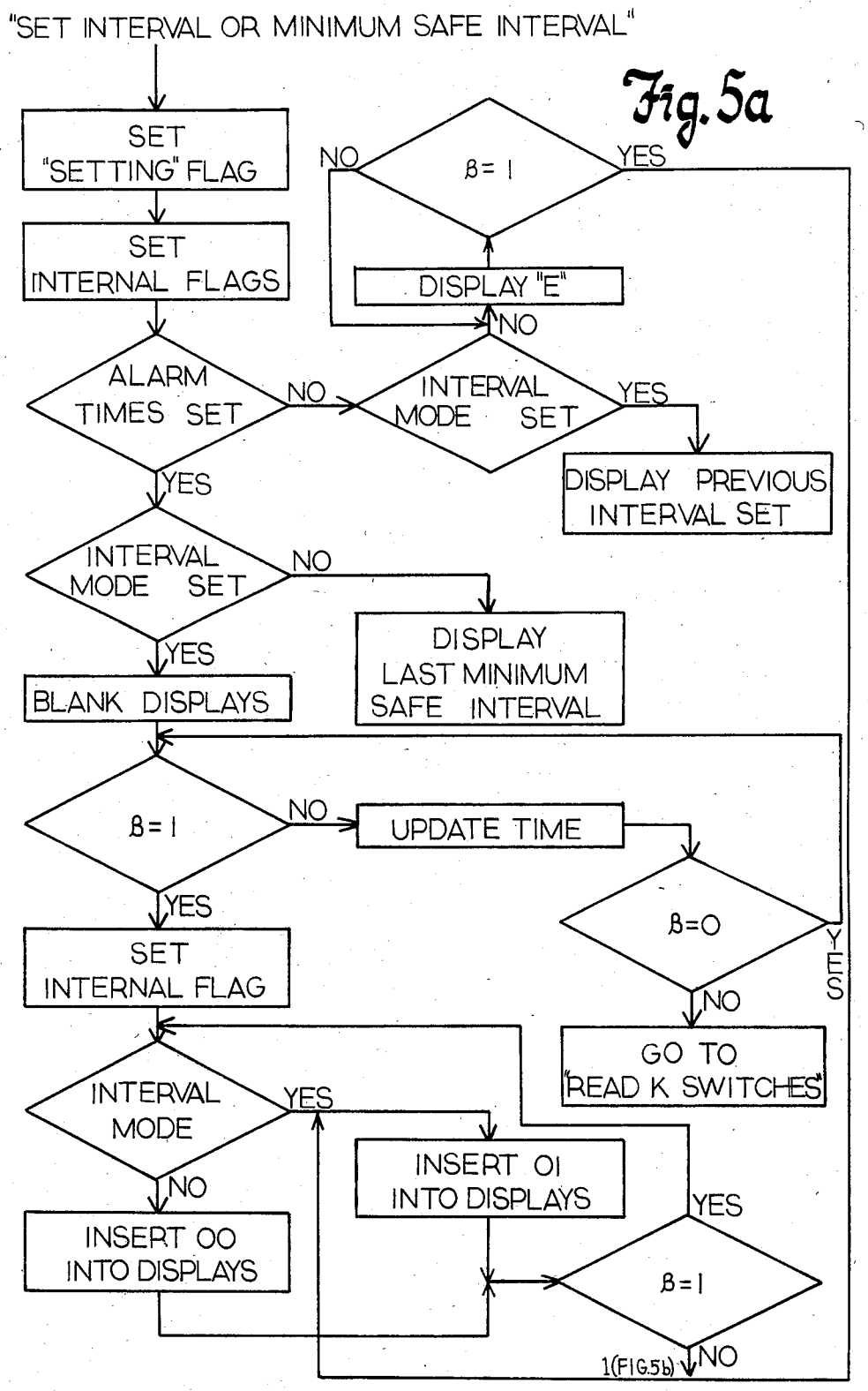
"SET INTERVAL OR MINIMUM SAFE INTERVAL"
Fig. 5a
SET "SETTING" FLAG
SET INTERNAL FLAGS
ALARM TIMES SET
NO
YES
INTERVAL MODE SET
NO
YES
DISPLAY "E"
β = 1
NO
YES
DISPLAY PREVIOUS INTERVAL SET
INTERVAL MODE SET
NO
YES
DISPLAY LAST MINIMUM SAFE INTERVAL
BLANK DISPLAYS
β = 1
NO
YES
UPDATE TIME
β=0
YES
NO
GO TO "READ K SWITCHES"
SET INTERNAL FLAG
INTERVAL MODE
YES
NO
INSERT 01 INTO DISPLAYS
INSERT 00 INTO DISPLAYS
β = 1
YES
NO
1(FIG.5b)

MEDICAL TIMER APPARATUS

MICROFICHE APPENDIX

A microfiche appendix is appended hereto comrising one (1) sheet and having seventeen (17) frames. This appendix contains a computer program that relates to the below described invention.

TECHNICAL FIELD

This invention relates generally to medical timer mechanisms.

BACKGROUND ART

Many drugs and medications currently prescribed by physicians require periodic administration at specified times. If the patient errs and repeats the dosage too frequently, an overdose may result. Similarly, if the patient should fail to administer the medication at the proper time intervals, the concentration of medicine in the patient's body may become too low.

Yet other drugs and medications are to be taken by a patient only when one or more specific symptons appear. These medications are hereinafter referred to as unscheduled medications. Again, the dosage for such symptomatic treatment cannot be repeated too frequently or an overdose may occur.

Therefore, certain time keeping responsibilities are clearly imposed when taking a medication. This time keeping responsibility falls of necessity upon either the patient or those who care for him. With regard to the latter, the problems are aggravated if more than one person cares for the patient, such as in semi-independent, family or institutional settings. Because of this, correct dosage administration has become one of the major responsibilities of various health care personnel. The multiple attendants must accurately communicate with one another or confusion may result as to when medicaton should again be administered. This situation may lead to under or over dosage of the medication.

Perhaps most commonly, the patient will note the current time on a watch or other standard time keeping device. On the basis of a physician's instructions regarding the minimum and maximum safe intervals between doses of medication, and on the basis of the total amount of medication to be administered over a possibly extended period of time, the patient then calculates the time when the next medication should be taken and commits the calculated time to memory. When the latter time arrives, the patient readministers the medication and repeats the process.

A number of disadvantages become apparent in this prior art method. For instance, the patient or caretaker may not correctly remember the appropriate time, or the individual may be otherwise distracted at the predetermined time and fail to administer the medication. These problems become particularly acute with patients whose mental or physical conditions make them less capable of reliably discharging such actions, or, as mentioned above, where a number of persons are responsible for the patient.

Other suggested solutions to this problem are found in the prior art. A number of devices are designed to either minimize the mental calculation involved and/or to operate as reminder devices. Such a device may comprise a small pill case having a timer and alarm built into it such that when the alarm sounds, the patient will be alerted and hopefully act in accordance with the instructions provided by the physician's prescription.

Typically, these devices act only as simple alarm clocks that include the sometimes convenient feature of positioning the medication proximal to the clock. Other than sounding an alarm at the designated time, however, no provisions are made to ensure or urge compliance with the medication schedule. The user can simply shut off the alarm and never take any further steps towards administering the medication, either through intentional or unintentional neglect, thereby risking an underdose condition. Further, if the user does take the medication on schedule, he may still neglect to restart the timing function, and thereby risk either an overdose or an underdose condition.

Another problem can arise where a number of alarm set times are provided or where a pre-set time interval is provided that begins anew with the sounding of an alarm. In these cases, where a patient neglects to take his medication for some time following the designated time, an overdose condition can arise if the next scheduled alarm occurs too soon after the actual administration of the medication.

Finally, and perhaps most fundamental when viewed from the perspective of those who are charged with monitoring the progress of the patient in question, the prior art devices do little to encourage or monitor compliance with the prescribed medication regiment. When a patient returns to a physician, the physician must essentially trust the patient's word or memory with respect to his record of compliance. Because of this, some physicians may avoid prescribing certain medications for particular patients that might be more effective than the medications actually prescribed, but for which the physician must be fairly certain that compliance will be met.

In an earlier issued U.S. patent (U.S. Pat. No. 4,361,408), I disclose a timer and alarm apparatus useful for the periodic dispensation of medicine. This device included a pressure sensitive switch that could be operably connected to a medication container. Upon squeezing the pressure sensitive switch when opening the container, the switch would signal the alarm mechanism to terminate sounding the alarm. In other words, an act that would normally indicate compliance with the medication schedule also caused the alarm to cease.

In another earlier filed U.S. patent application (Ser. No. 421, 681), I disclose another timer and alarm apparatus useful for the periodic dispensation of medicine. This device included a timing and alarm mechanism that could be used with either integral or non-integral medication compartments. The device further included a magnetically-responsive switch that sensed the opening of the integral or non-integral medication compartment. This sensing was utilized to reinitiate the timing function.

The prior art lacks a medical timer mechanism that includes a time of day clock, that would be responsive to the dispensation of medication and/or parameters that evidence dispensation of medicine, that would measure elapsed time between dispensations of medicine and that would further operate to alert the user to check the measured elapsed time when that action may be medically necessary, that would provide for the entry of alarm times either by designation of a plurality of times of day or by setting a time interval between dosages, that would allow a minimum safe interval between dosages to be set such that the apparatus would signal user not to take medication during this period of time, that would indicate a specific predose interval during which it may be safe for the user to administer medication even though the scheduled administration time had not yet arrived, that would provide for intervals between dosages of more than twenty-four hours to accommodate a variety of medications that necessitate such a schedule, and that would monitor, record and communicate the degree to which the user has complied with the medication schedule and that would provide some useful indicia of that record of compliance.

The prior art also lacks a useful medical timer device that would operate to provide certain of the above desirable attributes without necessarily providing all.

DISCLOSURE OF THE INVENTION

These and other desirable attributes are provided in the instant invention through the use of a microprocessor based medical timer and alarm apparatus that monitors and is sensitive to parameters that evidence dispensation of medicine; in this case, the opening of a medicine storage container.

The device in general includes a time of day clock unit, an elapsed time measurement unit for measuring time between preselected monitored events (such as openings of the monitored medicine storage container), and a dual mode alarm set mechanism that allows an operator to input alarm times in either of two modes. More particularly, the operator may enter up to six preselected time of day settings (in 10 minute intervals such as 8:00 a.m., 12:10 p.m., 4:40 p.m., etc.) or by inputting one preselected time interval (such as four hours).

The invention also provides for a minimum safe interval between dosages and a predosing interval. Minimum safe interval between dosages information may be input such that a minimum safe interval between dosages unit will operate to assist in avoiding an overdose condition. Such an overdose condition can accidentally arise, for instance, when a patient is late in taking one scheduled dosage, and than takes the next scheduled medication at the previously scheduled time. Similarly, an overdose condition could arise when severe symptoms cause a patient to take uscheduled medications too frequently.

The minimum safe interval between dosages unit operates to display a "do not take" signal to the operator during the entire minimum safe interval between dosages. This signal will be displayed even when a previously scheduled time for dosage administration arrives.

The predosing interval operates under appropriate circumstances, to provide a time interval between the expiration of the minimum safe interval between dosages and the next scheduled dosage. The predosing interval unit operates to inform a patient that medication might safely be dispensed even though the scheduled time for its dispensation has not yet arrived. This information may be used by the patient or those responsible for his care to better plan dosage administration, to accommodate the patient's schedule, and to aid in the avoidance of an underdosage condition. Whether or not a particular medication could actually be taken by a patient in a particular situation during this interval would, of course, depend upon a physician's previous instructions in this regard.

The medical timer and alarm apparatus of the instant invention also provides, under appropriate circumstances, a warning to "check elapsed time" since the last dosage administration. This warning is presented to the operator when two scheduled dosages have passed without the medicine storage container having been opened. With this warning, the operator will be warned not only that a dosage has been missed, but he may then act upon his physician's instructions with respect to whether an additional quantity of medication or a different medication should be taken to compensate for the missed dosage.

The invention also operates to monitor, record and communicate the operator's compliance with the prescription schedule and further provides a score that reflects the degree of compliance.

The display face of the invention includes four seven segment display characters for displaying the time of day, the elapsed time, the alarm times or preselected alarm interval, the minimum no dose interval, and the compliance score. In addition, a number of signal flags are provided, including a "do not take" signal, a "1 hr. predose" signal, a "check elapsed time" signal, a take signal, a "score" signal, an "elapsed time" signal, and an am/pm indicia. Other flags, such as "over 100 hours", "setting", and a squelch indication are provided for functions that are described in more detail below.

The above functions are accomplished through the use of software and through appropriate hardware connections to necessary peripherals of the microprocessor and display.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 4*a–b* is a flow chart diagram of the set alarm time function;

FIG. 5*a–b* is a flow chart diagram of the set interval or minimum safe interval between dosages function;

BEST MODE FOR CARRYING OUT THE INVENTION

The Circuitry

Figure 1:
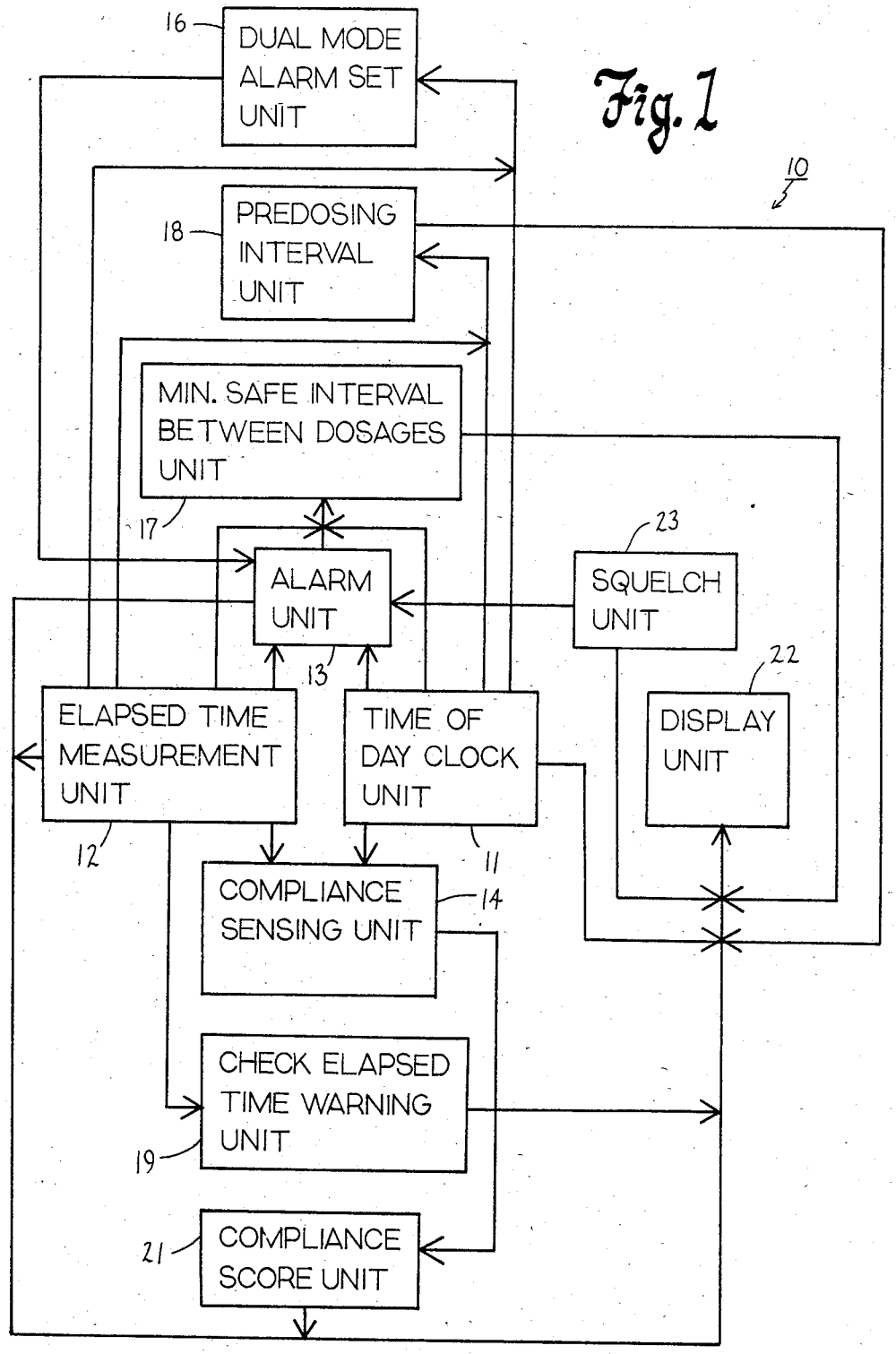
FIG. 1 is a block diagram depiction of the invention.

Referring now to the drawings, and in particular to FIG. 1, the apparatus of the invention may be seen as depicted generally by the numeral 10. The apparatus (10) includes generally a time of day clock unit (11), an elapsed time measurement unit (12), an alarm unit (13), a compliance sensing unit (14), a dual mode alarm set unit (16), a minimum safe interval between dosages unit (17), a predosing interval unit (18), a check elapsed time warning unit (19), a compliance score unit (21), a display unit (22) and a squelch unit (23).

Referring to FIG. 2-*b*, many of the above units are realized herein through the provision of a microprocessor (24). In addition, a liquid crystal display (26) serves as the display unit (22) and various other peripheral structures are provided to allow operator control over the above units and to ensure appropriate functioning of the microprocessor (24).

Such peripherals include a mode switch (27), a squelch switch (28), and a reset switch (29). Other peripheral connections include generally appropriate power source connections (31), an auto clear connection (32) and a crystal oscillator connection (33). Finally, the microprocessor (24) also connects generally to an LED (34), an audio alarm (36) and to the DC power source (37) for low power monitoring purposes.

The above units will be described herein in greater detail, both with respect to the implementing hardware and with respect to the implementing software.

The microprocessor (24) may be provided by a Sharp SM-4. Such a microprocessor comprises a versatile, CMOS device that includes a number of features useful towards realizing the instant invention. These features include an instruction set well suited to time keeping functions, a variety of mode input controls, and an internal liquid crystal display drive circuit. Other microprocessors, or discrete circuitry, could be utilized here, of course, to effectuate identical results.

The mode switch (27) may be provided by use of a ten position binary coded decimal switch, such as model number 230002G as manufactured by the E.E.C.O. Company. This switch includes a manually operable control that may be positioned at any one of ten positions, each position providing a discrete binary coded decimal signal at the output of the switch.

The $D_0$ through $D_3$ ports of the switch (27) connect to the $K_1$ through $K_4$ ports of the microprocessor (24), respectively. Each of these four switch ports (27) are also connected in parallel through discrete 1 megohm resistors (38) to the battery power supply (39). Finally, the ground port of the switch (27) connects to ground.

The squelch switch (28) comprises a normally open switch having one end tied to ground and the remaining end connected both through a 1 megohm resistor (41) to the power supply (39) and to the beta input of the microprocessor (24). The beta input of the microprocessor (24) constitutes an alarm silence control port for control of the microprocessor signalled alarm function and also serves certain functions when setting the time or inputting alarm time data.

The compliance sensing unit (14) includes a compliance sensing switch (29) that comprises a normally open switch connected at one end to ground and at the remaining end to both the $DI0_2$ port of the microprocessor (24) and through a 1 megohm resistor (42) to the power supply (39). The $D10_2$ port of the microprocessor (24) comprises a reset port for certain microprocessor functions.

The compliance sensing switch (29) must be positioned to be responsive to parameters that indicate compliance with the medication schedule. For instance, the compliance sensing switch (29) could be a magnetic reed switch installed so as to be sensitive to a magnet located within a pill drawer. Upon opening the pill drawer, the magnetic reed switch would close, and thereby provide a signal to the microprocessor (24) that the pill drawer had been opened. Other configurations are possible as well, but there is no need here to elaborate in detail any of these alternatives.

The power supply (31) may be provided herein by the provision of two 1.5 volt cells (39). The two cells (39) are serially connected with one end tied to ground.

The low battery monitoring function (37) of the invention may be provided by tying the low end of the power source (31) through a 470 K ohm resistor (46) to the BA port of the microprocessor (24). The BA port connects to internal circuitry that monitors for low voltage conditions.

The auto clear function (32) may be provided by the connection of a 0.1 microfarad capacitor (47) between the ACL port of the microprocessor (24) and ground.

The crystal oscillator (33) oscillates at a frequency of 32,768 hertz. The crystal oscillator (33) connects to both the oscillator in and oscillator out ports of the microprocessor (24). The crystal oscillator (33) also connects through a 20 picofarad capacitor (49) to ground and through a 5 to 47 capacitor (48) to ground as indicated.

The alarm (36) may be provided by a piezo ceramic buzzer (51) connected in parallel with a diode (52) between ground and through a 1 K ohm resistor (53) to the $R_1$ port of the microprocessor (24).

Finally, a light emitting diode (34) may be connected between ground and through a 200 ohm resistor (54) to the $R_3$ port of the microprocessor (24).

The display unit (22) includes a liquid crystal display (26), which display will now be described prior to describing the connections between the liquid crystal display (26) and the microprocessor (24).

Liquid crystal displays are typically formed of flat panels of glass that are hermetically sealed with a layer of liquid crystal material between them. The inside surfaces of the glass plates each have a transparent conductive layer of material such as tin oxide evaporated or spattered onto the glass.

In use, the conductive material disposed on the inner surface of the glass plates wil be formed in the shape of the desired segment display, such as an alpha-numeric character or portion thereof. Upon energizing the opposing conductive materials, the molecular contents of the liquid crystal material may be electrically rearranged. This will cause the material located between the opposing conductive surfaces to appear to the eye as a color or shade distinguishable from the main body of liquid crystal materials, which comprise the background color.

It is well known in the art to create multiplexed liquid crystal displays, such that a single input conductor may be attached to two or more visually discrete symbols. The construction of such displays being well known in the art, no further discussion will be presented here with respect to the actual construction of such a display.

The liquid crystal display (26) includes a number of alpha-numeric character displays and signal flags. Four separate seven segment displays (56) are provided for use in displaying the time of day, elapsed time, alarm set times, and compliance scores. In addition, a colon (57) has been provided between the second most significant digit and the second least significant digit for appropriate use in displaying the time of day.

The liquid crystal display (26) further includes a "do not take" signal flag (58), a "1 hr. predose" signal flag (59), a "check elapsed time" signal flag (61), a cup-shaped hand symbolizing the take command (62), an "elapsed time" signal flag (63), a "score" signal flag (64), an "over 100 hours" signal flag (66), a "setting"

signal flag (67), a squelch indication signal flag (68) and an am/pm signal flag (69).

Figure 2A:
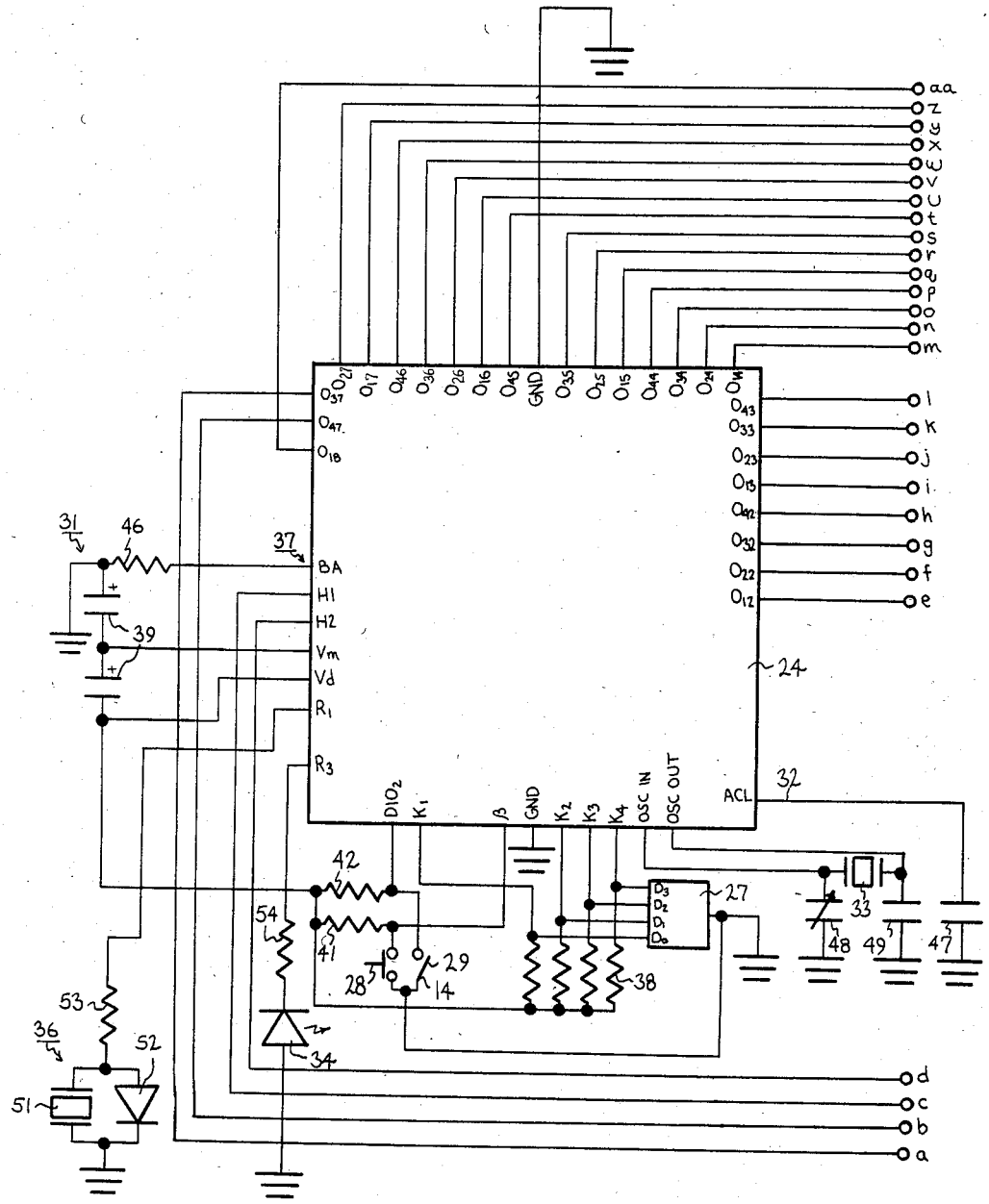
FIG. 2*a–b* is a schematic diagram of the unit.
Figure 2B:
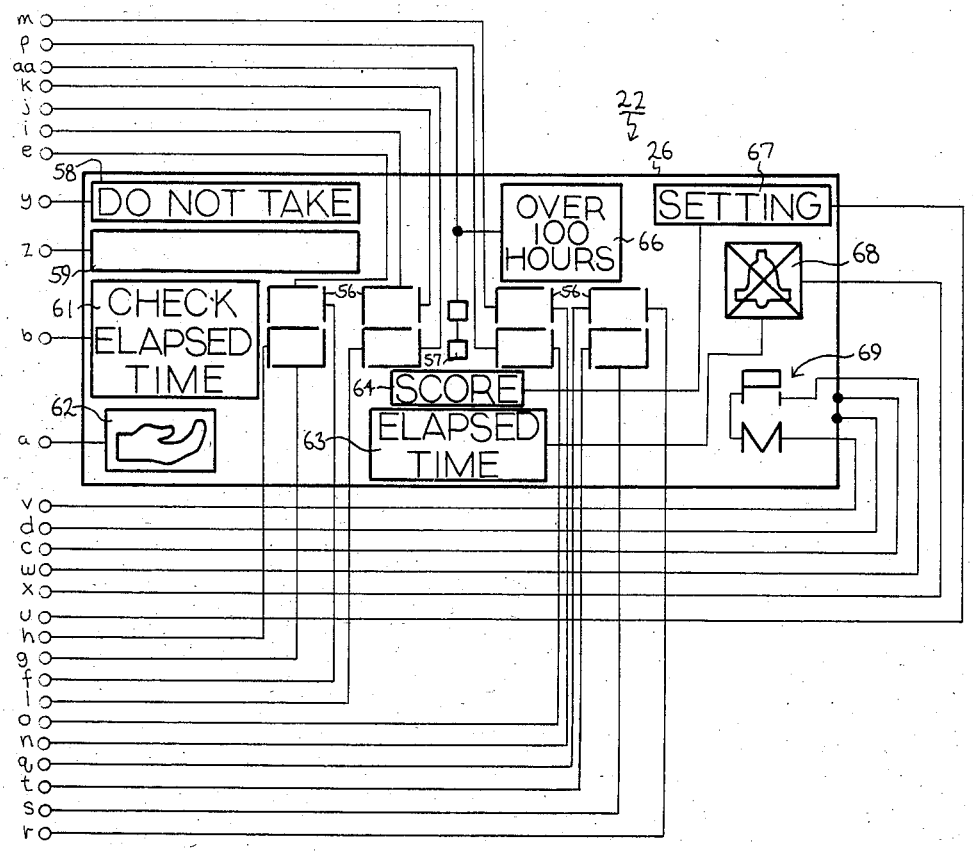

Referring now to both FIGS. 2*a* and 2*b*, the interconnections between the microprocessor (24) and the liquid crystal display (26) will now be described.

The segments that comprise the most significant digit of the alpha numeric character display connect to the $0_{12}$, $0_{42}$, $0_{32}$, and $0_{22}$ ports of the microprocessor (24). The segments comprising the second most significant digit of the alpha numeric character display connect to the $0_{13}$, $0_{23}$, $0_{33}$, and $0_{43}$ ports of the microprocessor (24). The segments comprising the second least significant digit of the alpha numeric character display connect to the $0_{44}$, $0_{14}$, $0_{34}$, and $0_{24}$ ports of the microprocessor (24). Finally, the segments comprising the least significant digit of the alpha numerica character display connect to the $0_{15}$, $0_{45}$, $0_{35}$, and $0_{25}$ ports of the mircroprocessor (24).

The "do not take" signal flag (58) connects to the $0_{17}$ port of the microprocessor (24). The "1 hr. predose" signal flag (59) connects to the $0_{27}$ port of the microprocessor (24). The "check elapsed time" signal flag (61) connects to the $0_{47}$ port of the microprocessor (24). The cup-shaped hand flag (62) connects to the $0_{37}$ port of the microprocessor (24). The "elapsed time" signal flag (63) and the squelch indication signal flag (68) connect to the $0_{46}$ port of the microprocessor (24).

The "score" signal flag (64) and the "setting" signal flag (67) connect to the $0_{16}$ port of the microprocessor (24). The "over 100 hours" signal flag (66) and the colon (57) connect to the $0_{18}$ port of the microprocessor (24). The am/pm signal flags (69) connect to the $0_{26}$ and $0_{36}$ ports of the microprocessor (24). Finally, the background connections to the liquid crystal display (26) connect to the $H_1$ and $H_2$ ports of the microprocessor (24).

The microprocessor (24) contains stored in its read only memory a program (appended hereto in the microfiche appendix) that enables it to proceed in a logical and orderly fashion with respect to monitoring the passage of time and parameters that indicate compliance with the prescription schedule. Based upon this information, the program stored in the microprocessor (24) will allow the microprocessor (24) to control the display unit (22) in an appropriate manner to ensure appropriate action on the part of the patient. The drawings include a number of flow charts that illustrate certain aspects of the control logic provided by this program. These flow charts will now be referred to and described.

The Read K Inputs Sub-Routine

Figure 10:
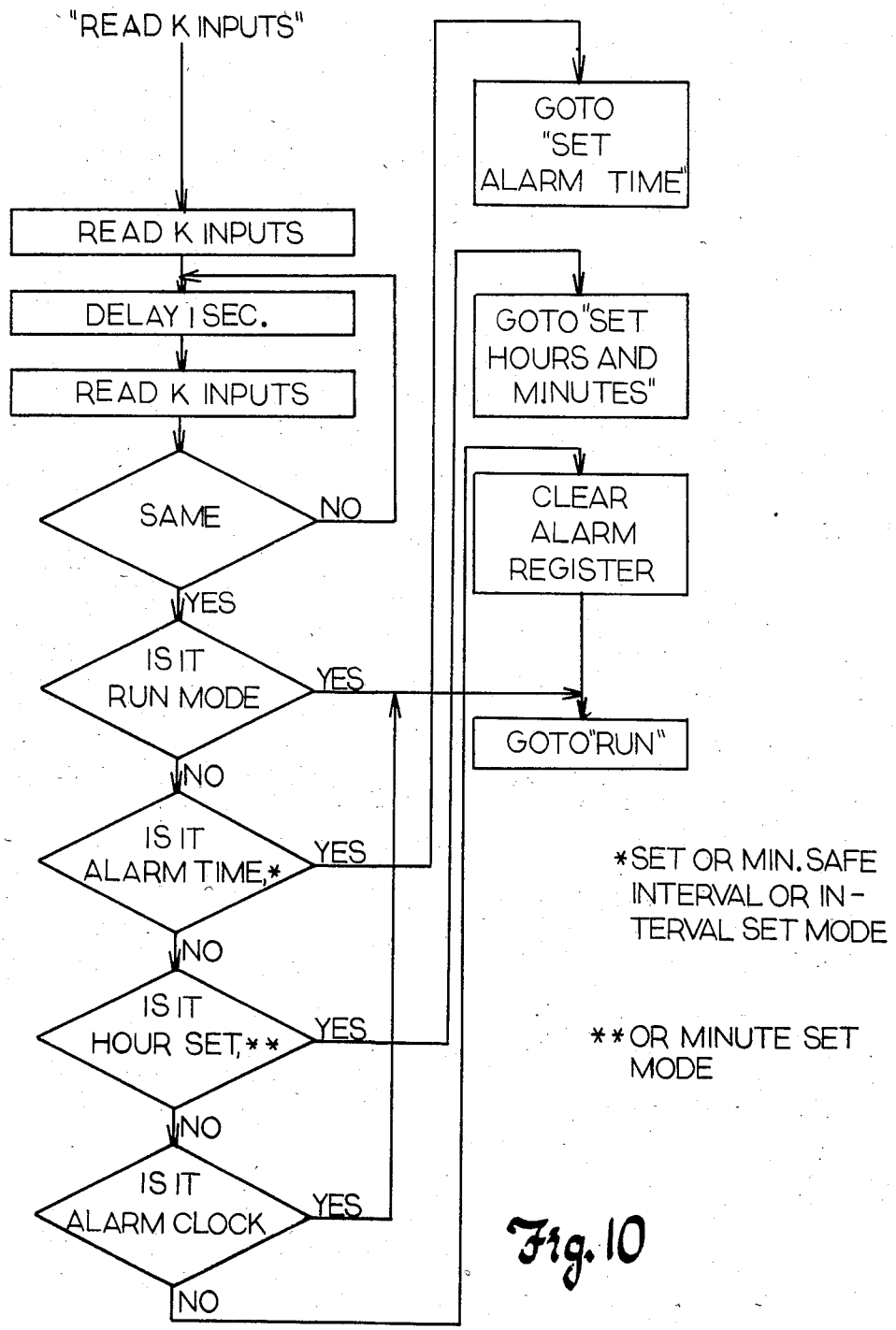
FIG. 10 is a flow chart diagram of the read k inputs function.

Referring to FIG. 10, a sub-routine entitled "read K inputs" will now be described. As noted above, the four K inputs to the microprocessor (24) are connected to the outputs of a 10 position binary coded decimal mode switch (27). By this sub-routine, the microprocessor (24) can review the setting fo this switch (27) and then act in accordance with such instructions.

The microprocessor (24) reads the input from the switch (27), delays one second and then reads the inputs again. If the two readings do not compare identically, the program loops back for another delay and another reading of the inputs. When two consecutive readings coincide, the program continues.

A determination is made as to whether the switch (27) coincides with a run mode instruction. If it does, then the microprocessor shifts to the "run" sub-routine. If not, the program continues and determines whether the switch (27) is at the position for setting the alarm time, the minimum safe interval or the interval set mode. If so, then the program shifts to the "set alarm time" sub-routine.

If not, the program continues and determines whether the switch has been set for time setting purposes. If so, the microprocessor shifts to the appropriate sub-routine. If not, the program continues and determines whether the invention has been placed in an alarm clock mode. If so, the microprocessor shifts to the "run" sub-routine. If not, the switch is assumed to be in the "clock only" mode and the registers in the microprocessor reserved for alarm data are cleared and the microprocessor continues to the "run" sub-routine.

The Run Sub-Routine

Figure 6:
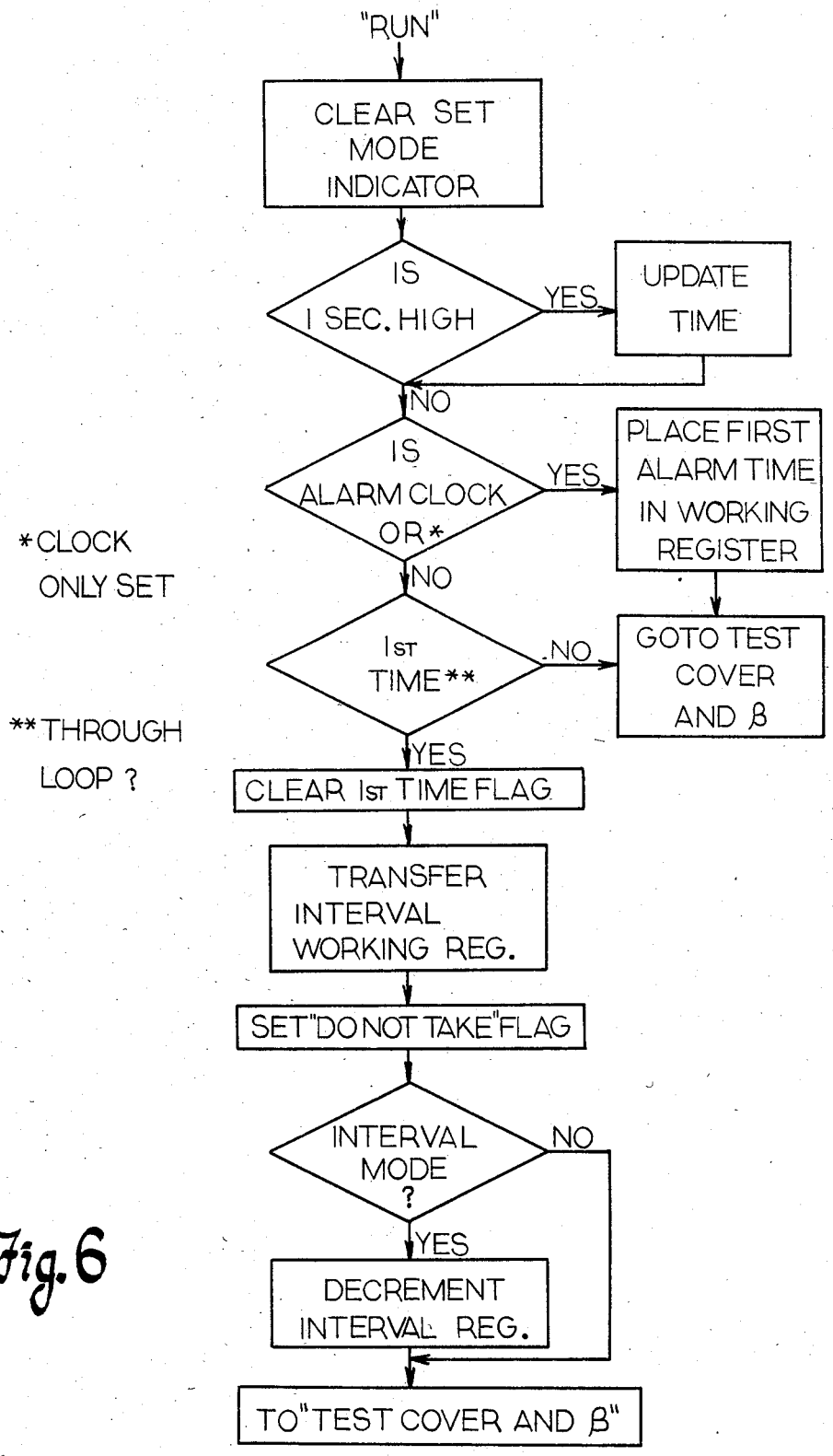
FIG. 6 is a flow chart of the run function.

Referring to FIG. 6, the "run" sub-routine will be described. The routine begins by clearing the set mode indicator, and then determines whether a 1 second register is high. If so, the microprocessor updates time and the routine continues. If not, the microprocessor does not update time and the routine continues. The microprocessor determines whether the invention has been placed in an alarm clock or clock only mode. If the alarm clock mode has been chosen, the microprocessor places a first stored alarm time in a working register and then shifts to the "test cover and beta" sub-routine. If not, the microprocessor continues and determines whether this constitutes the first time the program has run through this loop. If not, the microprocessor shifts to the "test cover and beta" sub-routine. Otherwise, the microprocessor clears a first time through flag and continues.

The microprocessor then transfers a previously stored alarm interval into a working alarm register. Following this, the "do not take" display flag (58) may be set. The microprocessor then determines whether the invention has been set in an interval mode. If so, the microprocessor will appropriately decrement the interval register and proceed to the "test cover and beta" sub-routine. Otherwise, the microprocessor skips the decrement step and proceeds directly to the "test cover and beta" sub-routine.

The Set Alarm Time Sub-Routine

Figure 4A:
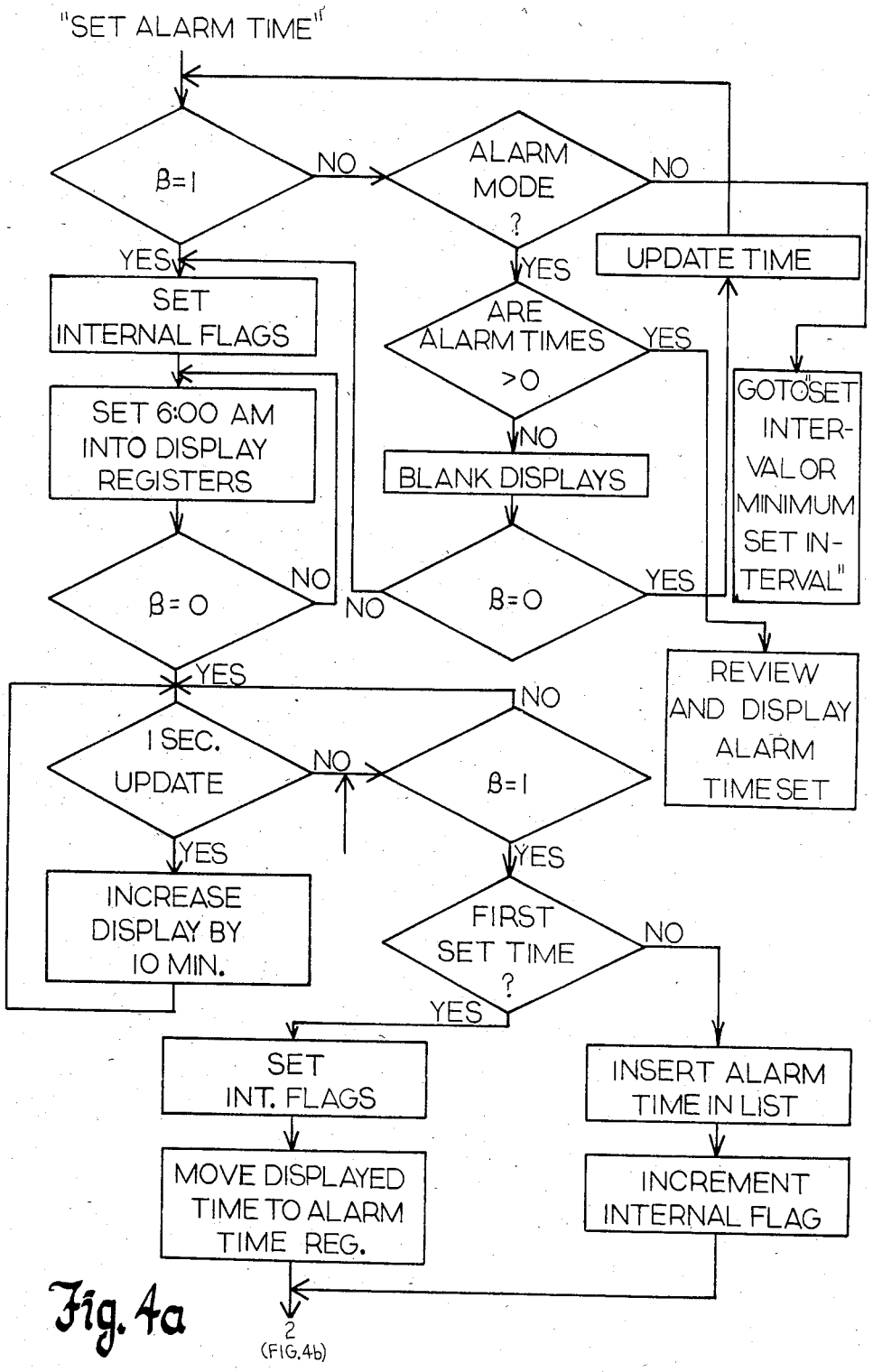

With reference to FIGS. 4*a* and *b*, the "set alarm time" sub-routine will be described. It should be recalled at this point that the beta input to the microprocessor (24) comprises an input whereby the microprocessor controlled audible alarm may be squelched. Such squelching occurs when a logical I appears at the input of the beta port. In addition, however, the squelch control (28) may be manipulated by the operator during the running of this sub-routine to control the functions that it performs.

This sub-routine begins by determining whether the beta port has a logical 1 input. If not, the program determines whether the invention has been set in an alarm mode. If not, the microprocessor shifts to the "set interval or minimum set interval" sub-routine. Otherwise, the microprocessor determines whether the alarm times stored are greater than 0. If they are, the alarm times are reviewed and displayed on the display unit (22). Otherwise, the displays are blanked.

The microprocessor then determines whether a logical zero appears at the beta input. If so, the microprocessor updates the time data and begins this sub-routine anew. Otherwise, the microprocessor will shift to that portion of the sub-routine that follows the affirmative branch of the initial status inquiry regarding the beta input.

Following this affirmative branch, appropriate internal flags are set and the microprocessor causes "6:00 a.m." to be shown on the display unit (220. The microprocessor then determines whether a logical zero appears at the beta input. If not, the microprocessor loops back to the display 6:00 a.m. instruction. Otherwise, the microprocessor determines whether a 1 second update has passed. If so, the microprocessor increases the time of day depicted on the display unit (22) by 10 minutes. The microprocessor then loops back to again determine whether another 1 second has passed. If 1 second has not passed during this inquiry, the microprocessor determines whether a logical 1 appears at the beta input. If not, the microprocessor again loops back to determine whether another 1 second interval has passed.

When a logical one does appear at the beta input, the microprocessor then determines whether any alarm times have previously been stored. If so, appropriate internal flags are set and the time displayed on the display unit (22) becomes stored in the alarm time register. Following this, the microprocessor again determines whether a logical 1 appears at the beta input. If not, time will be updated. Otherwise, the microprocessor will determine whether all six possible alarm times have been set. If so, the alarm times will be sequentially reviewed on the display unit (22). Otherwise, the microprocessor will loop back to allow additional alarm times to be input.

When the determination inquiry referred to above as to whether the first set time has been made can be answered in the negative, the alarm time displayed will be stored in memory without disturbing previously stored alarm times. An appropriate increment internal flag will then be posted, time will be updated, and the microprocessor will again rejoin the main sub-routine.

By this sub-routine, up to six discrete alarm times may be input and stored.

The Set Interval or Minimum Safe Interval Sub-Routine

Figures 4B, 5B:
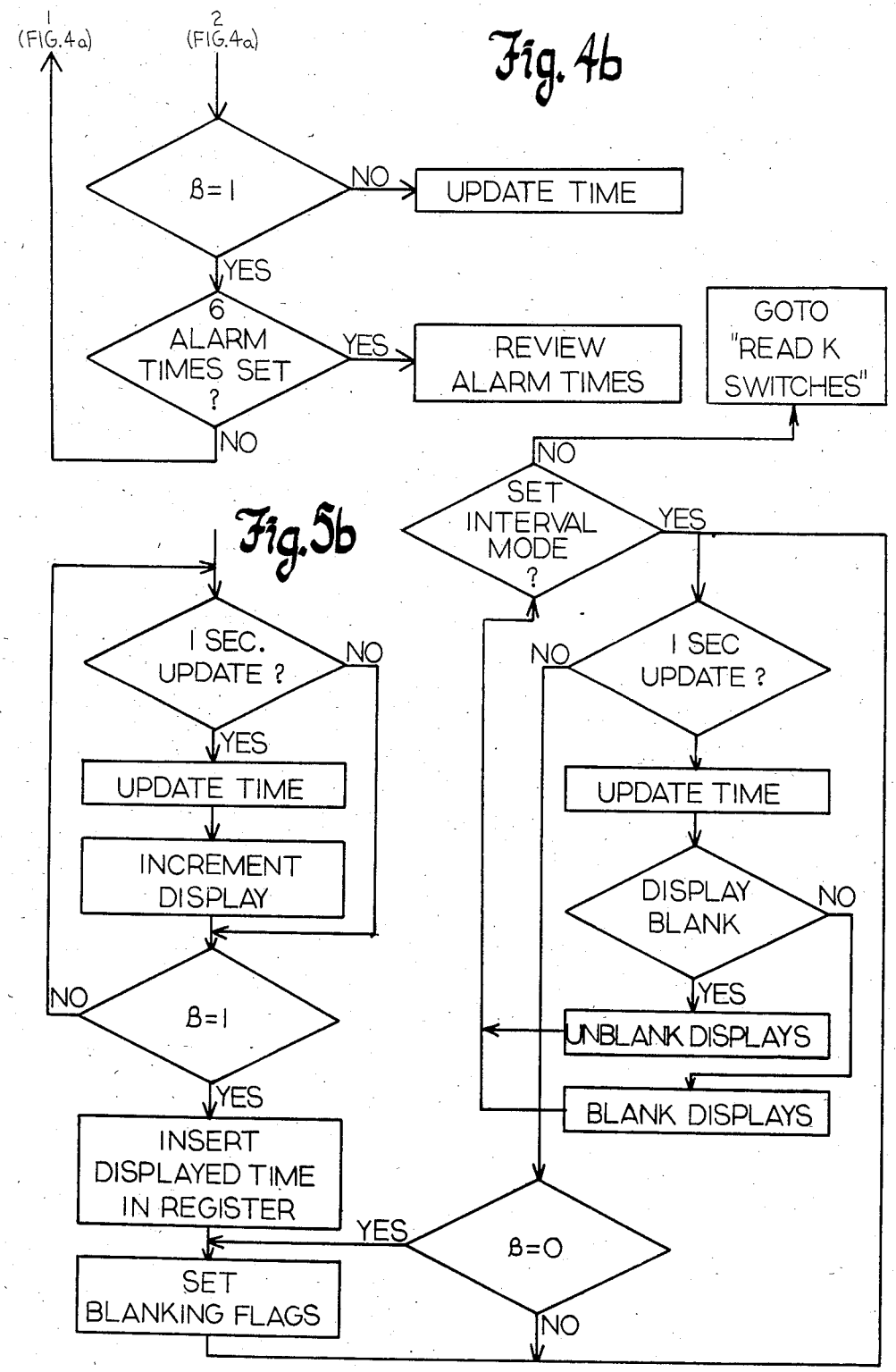

Referring to FIGS. 5*a* and *b*, the "set interval or minimum safe interval" sub-routine will be disclosed. The sub-routine begins by displaying the "setting" flag (67) and by setting certain internal flags relevant to the operation of the program. The microprocessor then determines whether any alarm times have been set. If not, the microprocessor determines whether the interval mode has been set. If so, then the previous interval time set will be displayed. Otherwise, an "E" will be displayed on the display unit (22) and the microprocessor will determine whether a logical 1 appears at the beta input. If not, the microprocessor continues to loop back through the display "E" instruction and the beta inquiry. When a logical 1 does appear at the beta port, the microprocessor will shift to an "Insert 01 into displays" program step described below.

Presuming that an affirmative response can be made to the alarm time set inquiry described above, the microprocessor then determines whether the interval mode has been set. If not, the last minimum safe interval will be displayed on the display unit (22). Otherwise, the display will be blanked and the microprocessor will determine whether a logical 1 appears at the beta input.

If not, time will be updated and the microprocessor will determine whether a logical zero appears at the beta input. If not, the microprocessor will shift to the "read K switches" sub-routine. Otherwise, the microprocessor will loop back and again determine whether a logical 1 appears at the beta input.

When a logical 1 does appear at the beta input, the microprocessor will set appropriate internal flags and then determine whether the invention is in an interval mode. If so, "01" will be shown on the display unit (22) and the microprocessor will determine whether a logical 1 appears at the beta input.

If not in the interval mode, then "00" will be shown on the display unit (22) and the microprocessor will likewise continue with the beta determination.

If a logical 1 appears at the beta input, the microprocessor will loop back and again determine whether the interval mode controls. Otherwise, a determination will be made regarding whether 1 second has passed. If not, the microprocessor will jump ahead to a beta inquiry noted below. Otherwise, time will be updated and the display unit (22) incremented. Then, the beta input will be examined to determine whether a logical 1 has been input. If not, the microprocessor will loop back to the 1 second inquiry. Otherwise, the displayed time will be placed in a storage register and blanking flags will be set.

Following this, the microprocessor will again determine whether 1 second has passed. If not, the beta input port will be examined for a logical zero. If present, the microprocessor will loop back to determine whether one second has passed. When one second has passed, the microprocessor will update time. The microprocessor will then determine whether the display unit (22) has been blanked. If it has been, the display will be unblanked. Otherwise, the display will be blanked. Following either of these instructions, another determination will be made as to whether the invention remains in a set interval mode. If so, the microprocessor will loop back to the 1 second inquiry. Otherwise, the microprocessor will shift to the "read K switches" sub-routine.

The Test Cover and Beta Sub-Routine

Referring now to FIGS. 7*a* through *e*, the test cover and beta sub-routine will now be described. This sub-routine includes a significant number of decisional branches. Therefore, this description of the sub-routine will first arbitrarily describe the steps that comprise the left-most column of FIGS. 7*a* and 7*b*. The decisional branches will then be considered in seriatim manner.

The microprocessor begins by determining whether a logical 1 appears at the beta input. If so, a flag indicating this will be set and the microprocessor will load and display elapsed time since the last closing of the medicine container cover.

The microprocessor will then determine whether the beta equal 1 flag has been set. If it has, a determination will be made as to whether this constitutes the first time the flag has been set. If so, a determination will be made as to whether the cover is open. If not, the microprocessor will determine whether the alarm buzzer is on. If the buzzer is not on, the microprocessor will turn it on.

Figure 7A:
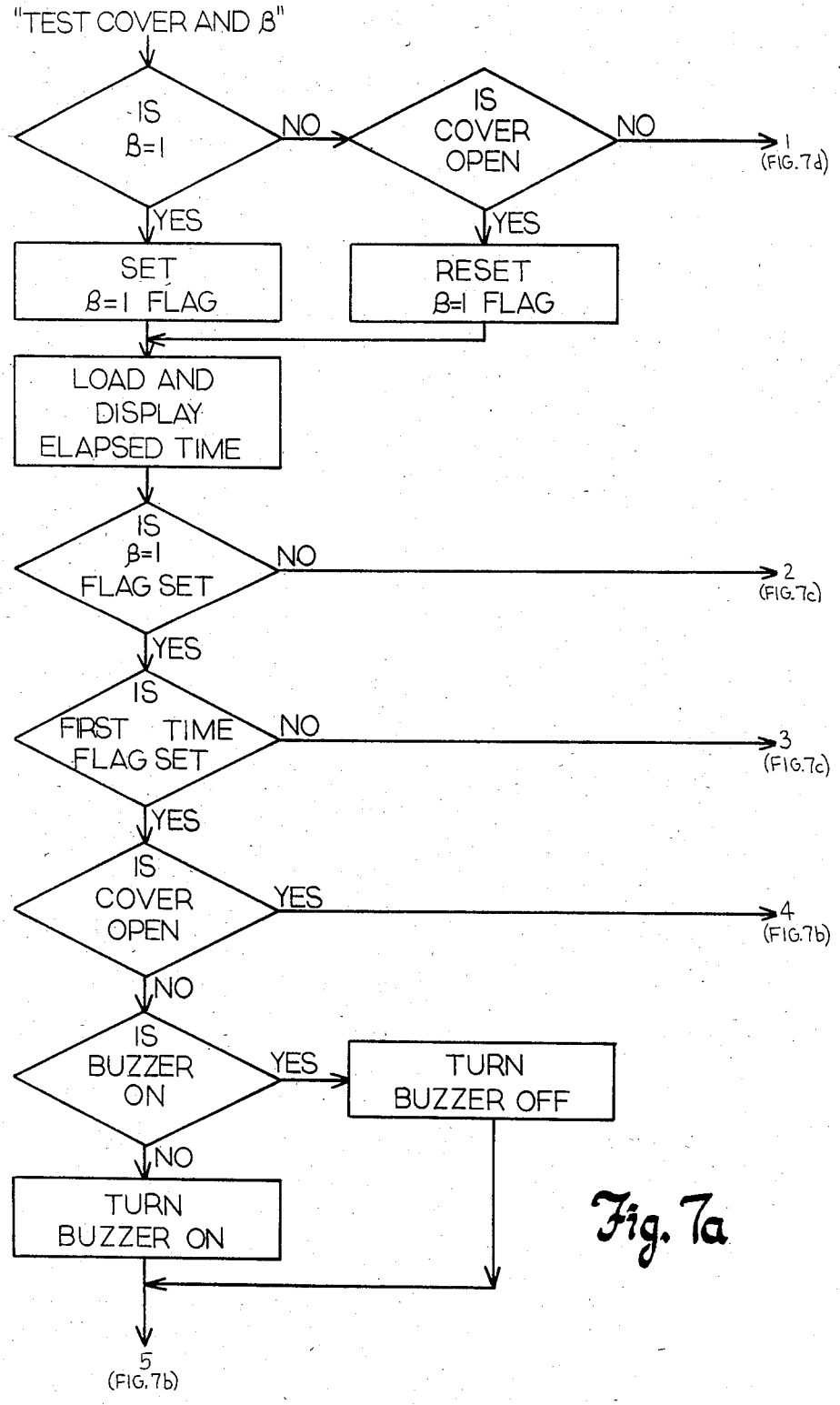
FIG. 7*a–e* is a flow chart diagram of the test cover and squelch function.
Figure 7B:
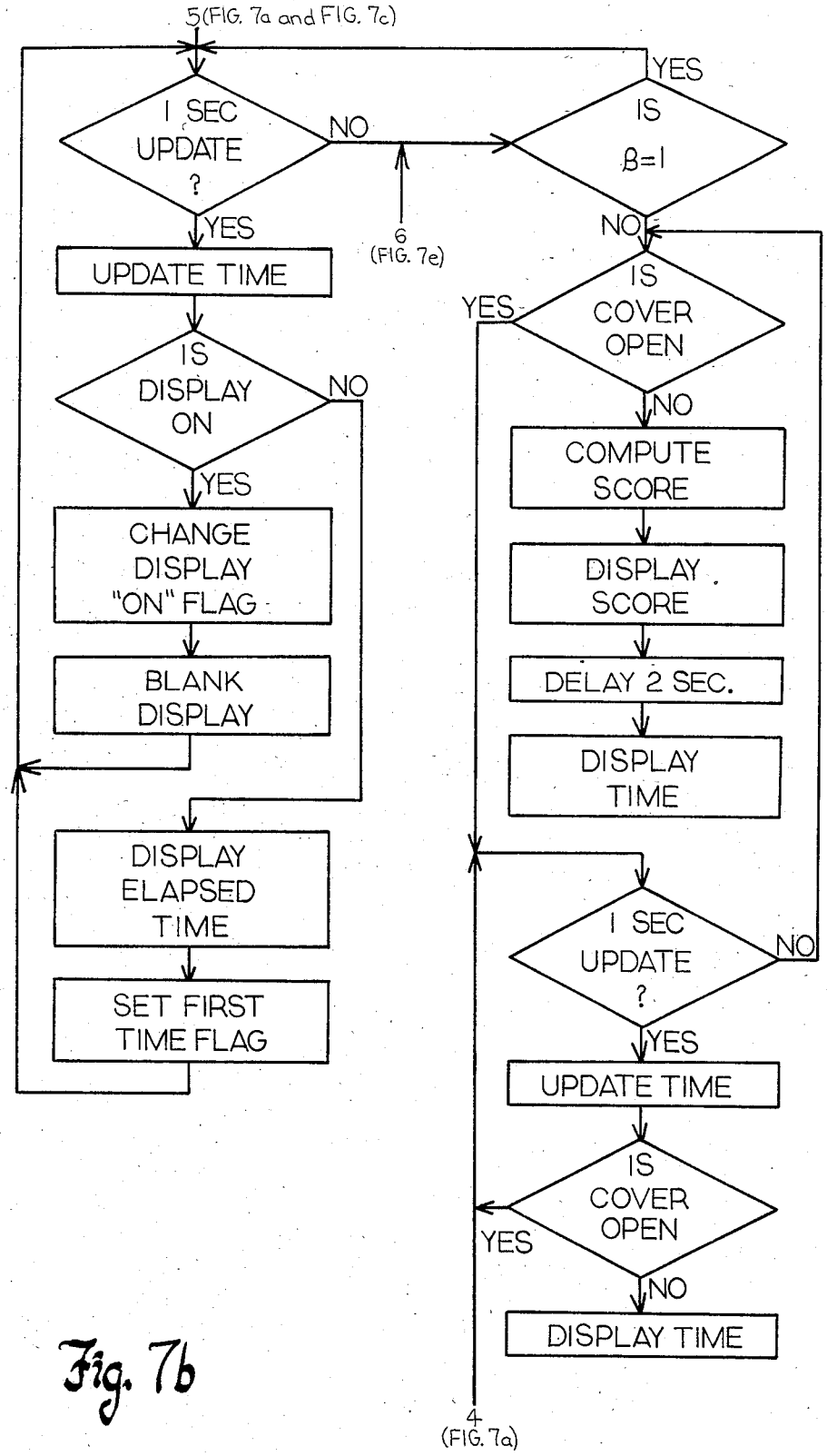
Figure 7C:
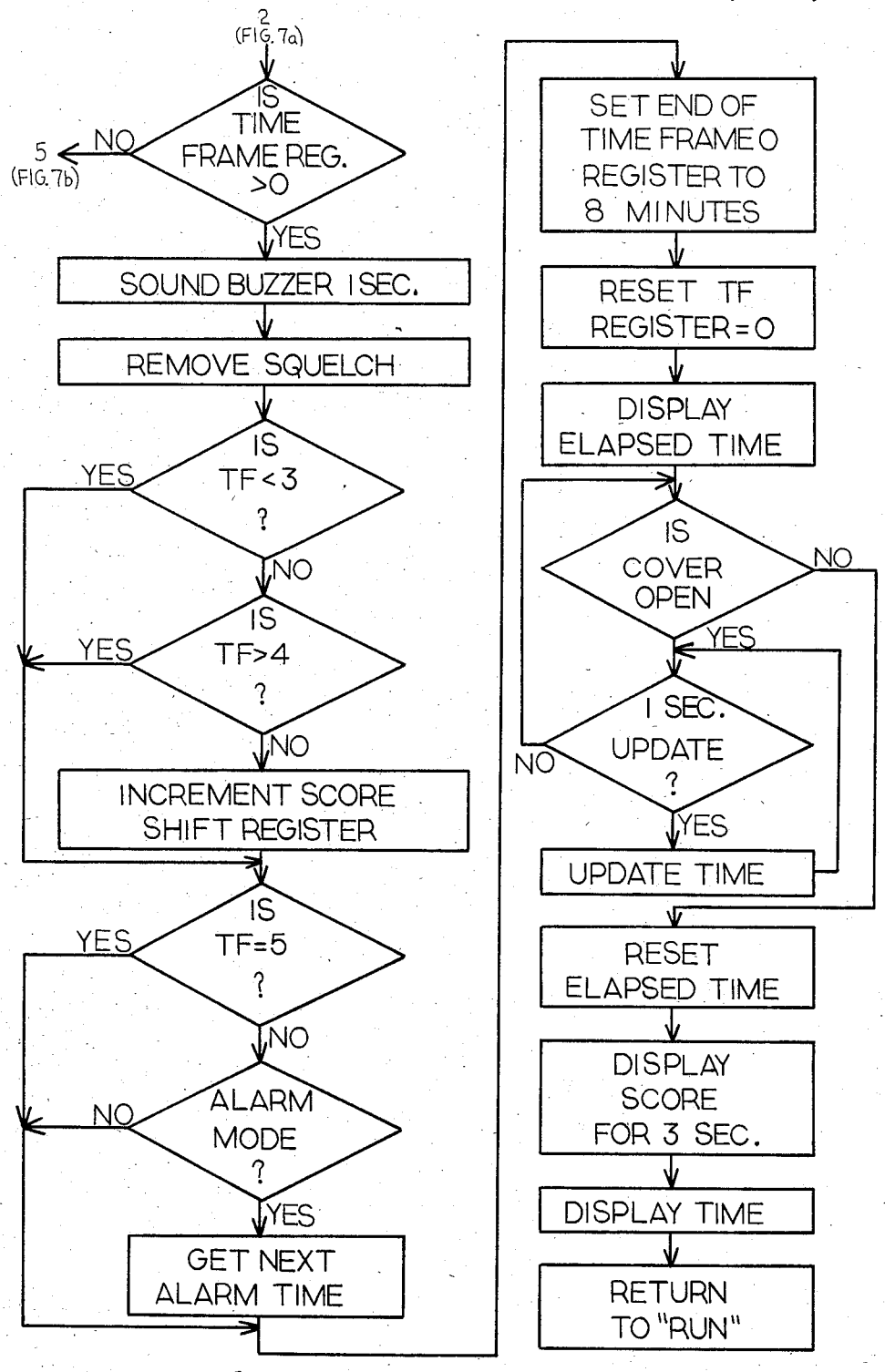

Continuing on to FIG. 7*b*, the microprocessor then determines whether a 1 second up-date has been made. If it has, time will be up-dated. The microprocessor will then determine whether the display is on. If it is, the display "on" flag will be changed and the display will be blanked. The microprocessor will then loop back to reinitiate the 1 second up-date inquiry.

When the microprocessor determines the "is display on" inquiry mentioned above in the negative, elapsed time since the last closing of the medicine container will be displayed. Then, a first time flag will be set indicating this to be the first time through this sub-routine. The microprocessor will then loop back to reinitiate the earlier inquiry regarding the 1 second up-date.

When the 1 second up-date inquiry can be responded to in the negative, another determination will be made regarding whether a logical 1 appears at the beta input. If it does, a microprocessor will again loop back to the one second up-date inquiry. Otherwise, a determination will be made as to whether the medicine container cover is open. If it is, the microprocessor will shift to a 1 second up-date inquiry described below. Otherwise, the microprocessor will compute the compliance score and display this score on the display unit. The microprocessor will then delay for two seconds and conclude by displaying the time of day.

If the 1 second up-date noted above can be answered in the negative, the microprocessor loops back to reinitiate the "is cover open" inquiry. Otherwise, the microprocessor will up-date the time and make a new determination regarding whether the medicine container cover is open. If it is not, the microprocessor will conclude by displaying the time. Otherwise, the microprocessor will loop back to reinitiate the 1 second up-date inquiry.

Referring back to FIG. *7a,* when the initial beta inquiry can be answered in the negative, a determination will be made regarding whether the medicine container cover is open. If it is, the beta equal 1 flag will be reset and the microprocessor will shift to the step described above where the microprocessor loads and displays elapsed time.

Where the cover is not open, (and referring to FIG. *7d*) the microprocessor determines whether the alarm mode has been chosen by the operator. If not, the microprocessor determines whether the interval entered by the operator has been reached. If not, the microprocessor determines whether the time frame exceeds 3 (meaning that the time to dispense medication has arrived or has been exceeded). If not, the microprocessor shifts to the "read k inputs" sub-routine. Otherwise, a determination is made regarding whether the alarm has been squelched. If it has, the microprocessor shifts to the "read k inputs" sub-routine. Otherwise, the microprocessor shifts to instructions that allow the sounding of the alarm.

When the alarm mode inquiry described above can be answered in the affirmative, the microprocessor determines whether the time frame exceeds or equals 2 (meaning that the minimum safe interval between dosages during the alarm time of day mode has been exceeded). If not, the microprocessor shifts back to the interval reached inquiry noted above. Otherwise, the microprocessor determines whether the alarm time has been reached. If it has not, the microprocessor shifts to the "read k inputs" sub-routine. Otherwise, the microprocessor shifts to a "time frame up-date" sub-routine.

When the interval reached inquiry noted above can be answered in the affirmative, the microprocessor shifts to the "time frame up-date" sub-routine.

Referring back to FIG. *7a,* when the "is beta equal 1 flag set" inquiry can be answered in the negative, the microprocessor determines whether the time frame register exceeds 0 (meaning more than eight minutes have passed since the last closing of the medicine container) (see FIG. *7c*). If not, the microprocessor shifts to the 1 second up-date inquiry described above (with respect to FIG. *7b*). Otherwise, the microprocessor sounds the alarm buzzer for 1 second and removes the squelch indicia from the display unit.

The microprocessor then determines whether the time frame is less than 3 (meaning it is not yet one hour before the scheduled time to take the medication). If so, the microprocessor shifts ahead to another time frame inquiry described below. Otherwise, the microprocessor determines whether the time frame exceeds 4 (meaning the alarm time has been reached and exceeded by one hour without the medication having been dispensed). If not, the score will be incremented and the program will continue.

Otherwise, a determination will be made as to whether the time frame equals 5 (meaning, in the alarm time of day mode, that more than an hour since the scheduled alarm time has passed, but the second alarm time has not yet arrived). If it has, the microprocessor shifts ahead to an instruction regarding the setting of the end of time frame register to eight minutes.

Otherwise, the microprocessor determines whether the alarm mode has been chosen. If it has not, the microprocessor shifts as described above. Otherwise, the microprocessor obtains the next alarm time and then sets the end of time frame 0 register to 8 minutes (by this instruction, the medication container can be opened and closed as many time as an operator might desire in the 8 minutes following the critical closing of the cover without disturbing the score compilation).

The microprocessor then resets the time frame register to 0 and displays elapsed time. Following this, the microprocessor determines whether the medication container cover is open. If it is not, the microprocessor resets the elapsed time counter, displays the compliance score on the display unit for 3 seconds, and then displays the time of day and returns to the "run" sub-routine.

If the cover is open, the microprocessor then determines whether the 1 second up-date has been reached. If it has not, the microprocessor loops back to redetermine whether the cover is open. Otherwise, the microprocessor proceeds to up-date time.

Referring back to FIG. *7a,* when the "is first time flag set" inquiry can be answered in the negative, the microprocessor sets a first time flag (see FIG. *7e*) and then determines whether the 1 second up-date has passed. If it has not, the microprocessor shifts to the beta inquiry described above with respect to FIG. *7b.* Otherwise, the microprocessor will up-date time and then loop back to reinitiate the 1 second up-date inquiry.

Referring gain to FIG. *7a,* when the "is cover open" inquiry can be answered in the affirmative, the microprocessor shifts to the 1 second up-date inquiry described above with respect to FIG. *7b.*

The Time Frame Up-Date Sub-Routine

Figures 7D, 7E, 8C:
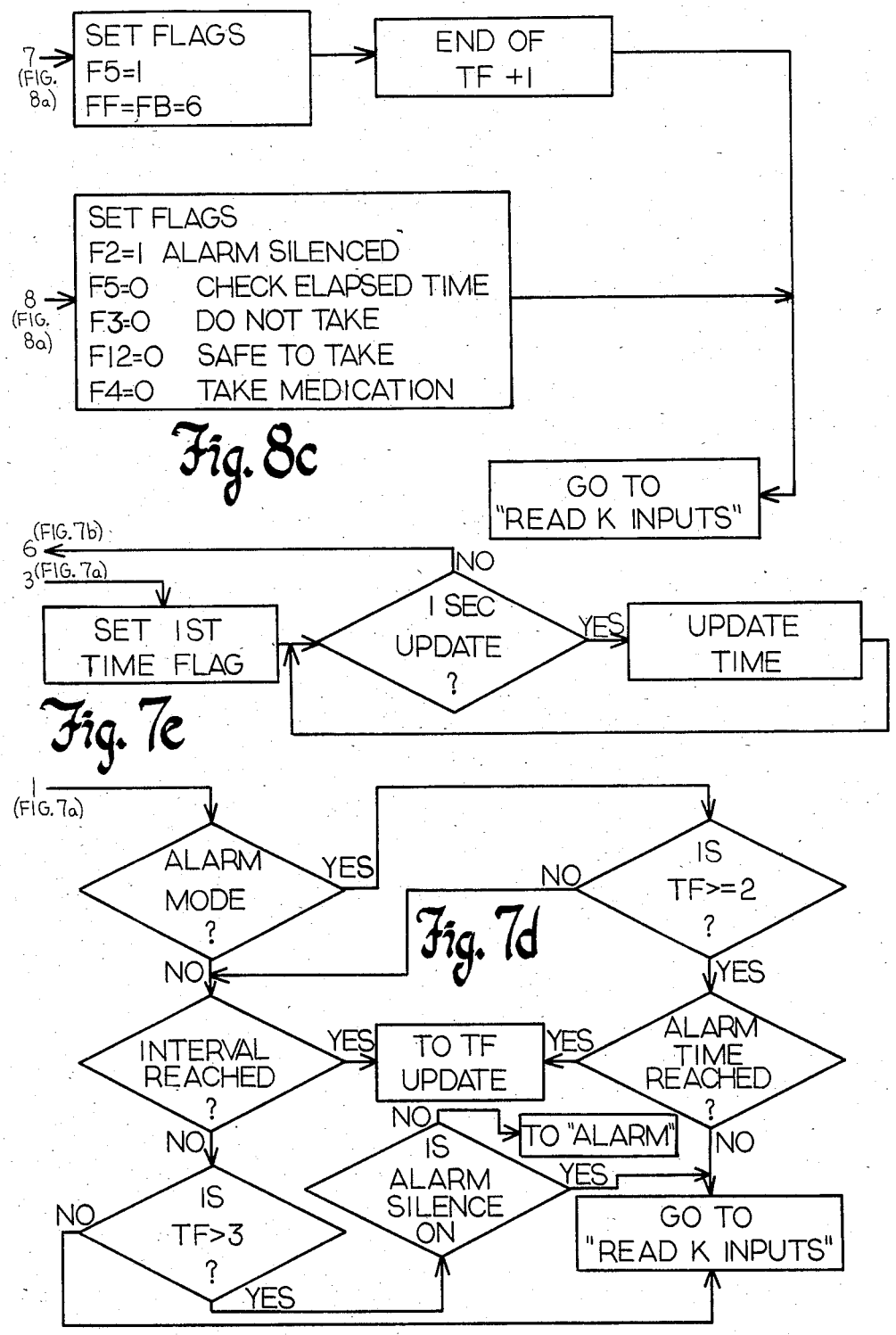
FIG. 8*a–c* is a flow chart diagram of the time frame update function.
Figure 8A:
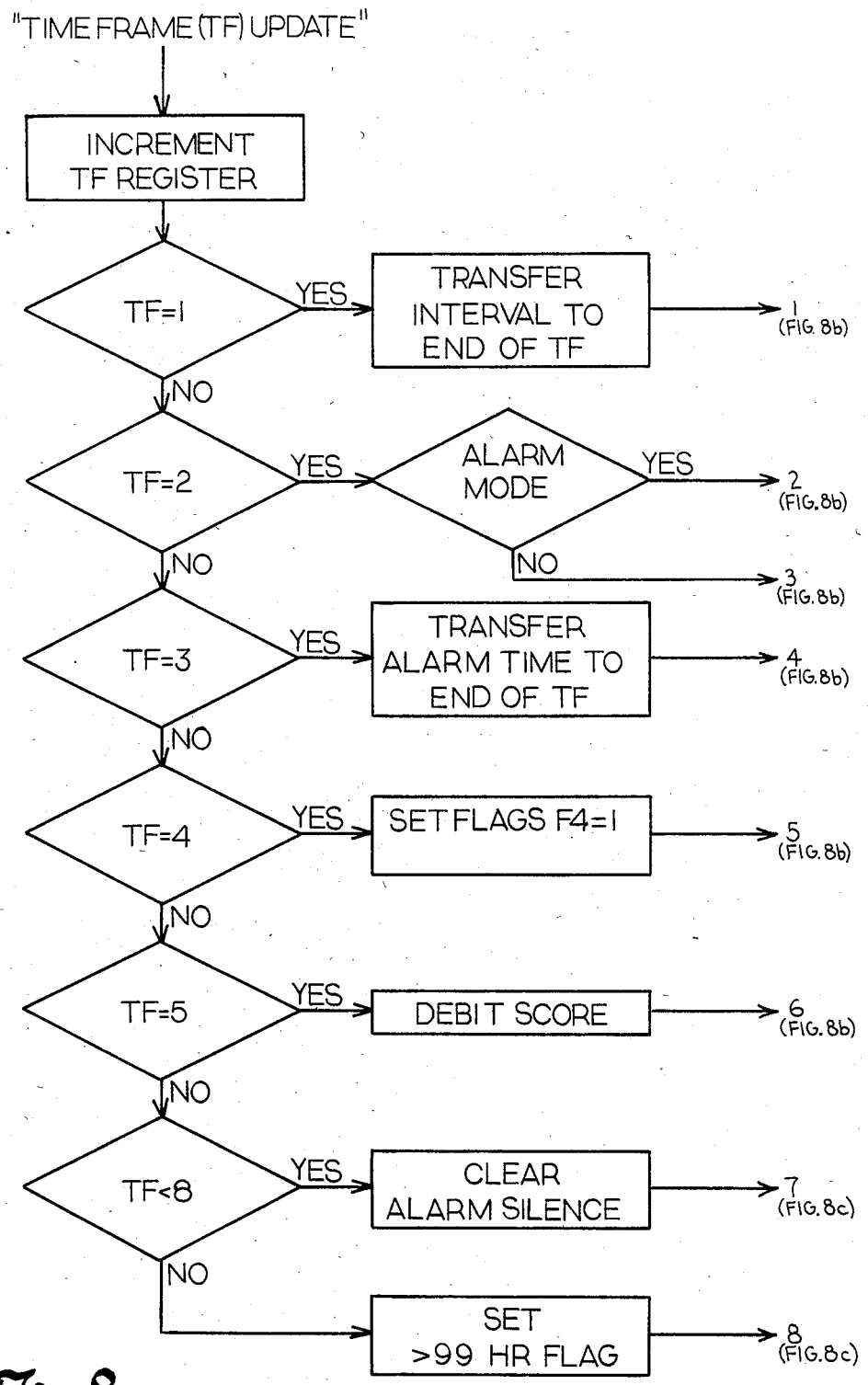
Figure 8B:
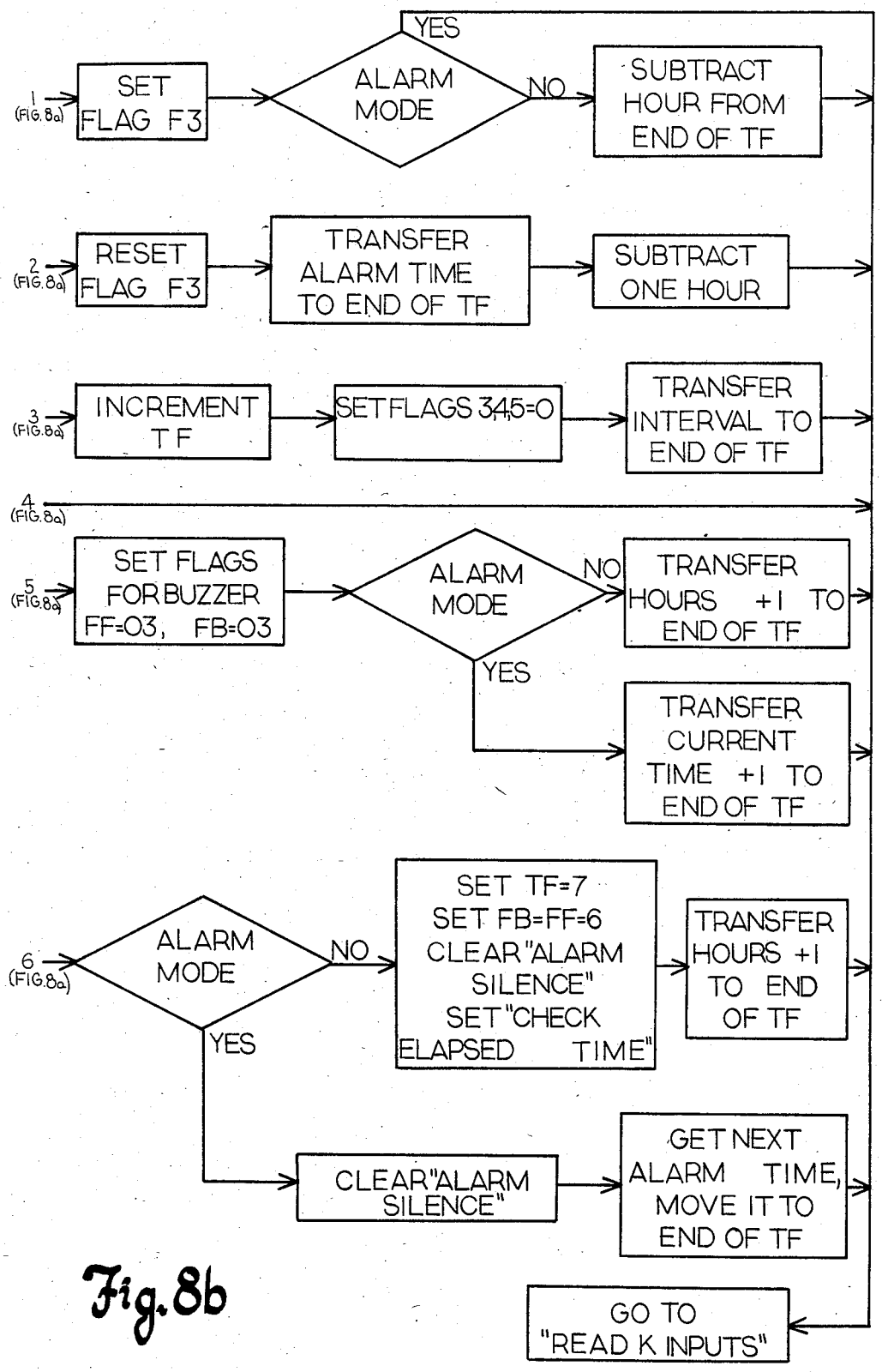

Referring now to FIGS. 8*a* through 8*c,* the "time frame up-date" sub-routine will be described.

The microprocessor first increments the time frame register and then determines whether the time frame register equals 1 (meaning the invention is in the minimum no dosage interval). If it does, the microprocessor will transfer the interval to the end of the time frame, set flag F3 (see FIG. 8*b*) (flag F3 corresponds to the "do not take" signal flag (58)) and then determine whether the alarm mode has been chosen. If it has, the microprocessor shifts to the "read k inputs" sub-routine. Otherwise, the microprocessor subtracts an hour from the end of the time frame and then proceeds to the "read k inputs" sub-routine.

Referring back to FIG. 8*a*, when the time frame does not equal 1, the microprocessor determines whether the time frame equals 2 (meaning, in the time of day alarm mode, that the minimum safe interval between dosages has ended). If it does, a determination is made as to whether the alarm mode has been chosen. If it has, the F3 flag is reset (to erase the "do not take" signal flag (58)) (see FIG. 8*b*), the microprocessor will transfer the alarm time to the end of the time frame, one hour will be subtracted from the time frame and the microprocessor will then proceed to the "read k inputs" sub-routine.

If the alarm mode has not been chosen, the time frame will be incremented, flags 3, 4 and 5 will be set at 0 (flag 4 corresponding to the cup-shaped hand signal (62) and flag 5 corresponding to the "check elapsed time" signal (61)). Then, the microprocessor will transfer the interval to the end of the time frame and will proceed to the "read k inputs" sub-routine.

Referring back to FIG. 8*a*, if the time frame does not equal 2, the microprocessor will determine whether the time frame equals 3 (meaning the invention is in the predosage interval). If it does, the microprocessor will transfer the alarm time to the end of the time frame. Then, the microprocessor will proceed directly to the "read k inputs" sub-routine (see FIG. 8*b*).

If the time frame does not equal 3 (see FIG. 8*a*), the microprocessor will determine whether the time frame equals 4 (meaning that the time has arrived to dispense the medication). If it does, flag F4 will be set to equal 1 (this flag corresponds to the cup-shaped hand indicia (62). Then, buzzer flags will be set and a determination will be made as to whether the operator has chosen the alarm mode.

If not, hours plus 1 will be transferred to the end of the time frame and the microprocessor will shift to the "read k inputs" sub-routine. Otherwise, the microprocessor will transfer the current time plus one hour to the end of the time frame and then proceed to the "read k inputs" sub-routine.

Referring back to FIG. 8*a*, if the time frame does not equal 4, the microprocessor will determine whether the time frame equals 5 (meaning, in the time of day alarm mode, that more than one hour has passed since the time to dispense medication without such dispensation having occurred). If it does, the microprocessor will debit the compliance score and then determine whether the alarm mode has been chosen (see FIG. 8*b*). If it has not, the microprocessor will set the time frame at 7 (corresponding to a time when sufficient time has passed following a missed dosage when the microprocessor will remove the alarm squelch if the alarm squelch had been previously activated), clear the alarm squelch indication (68) and set the "check elapsed time" signal (61). The microprocessor then transfers the hours plus 1 to the end of the time frame and proceeds to the "read k inputs" sub-routine.

If the alarm mode has been chosen, the microprocessor will clear the squelch if previously chosen, and will obtain the next alarm time and then move it to the end of the time frame. Following this, the microprocessor will proceed to the "read k inputs" sub-routine.

Referring back to FIG. 8*a*, if the time frame does not equal 5, the microprocessor will determine whether the time frame is less than 8 (meaning less than 100 hours have passed since medication should have been taken). If it is, the alarm silence will be cleared and certain internal flags corresponding to the "check elapsed time" signal indicia (61) and to provide for longer soundings of the buzzer (six seconds) (see FIG. 8*c*) will be set. The microprocessor will then proceed to the "read k inputs" sub-routine.

Referring back to FIG. 8*a*, if the time frame is not less than 8, the microprocessor will set the over 100 hours signal (66) and then proceed to set the alarm silence indicia (68) (see FIG. 8*c*) while inhibiting the "check elapsed time" signal (61) the "do not take" signal (58), the "1 hr. predose" signal (59) and the cup-shaped hand indication (62). Following this, the microprocessor shifts to the "read k inputs" sub-routine.

The Alarm Sub-Routine

Figure 9:
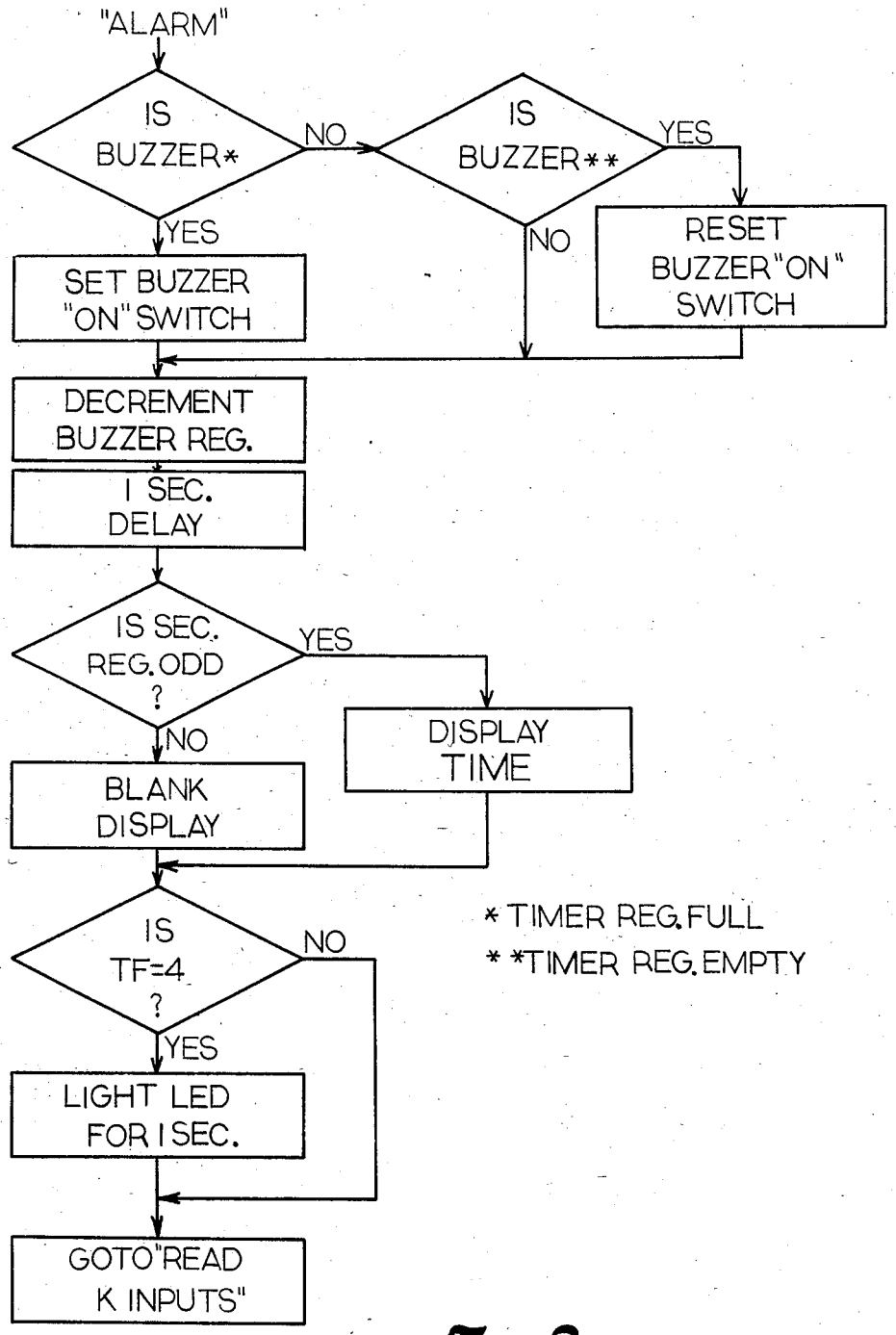
FIG. 9 is a flow chart diagram of the alarm function.

With reference to FIG. 9, the "alarm" sub-routine will be described. The sub-routine begins by having the microprocessor determine whether the buzzer timer register is full. If it is not, the microprocessor determines whether the buzzer timer register is empty. If it is, the microprocessor will reset the buzzer "on" switch and then shift back to the main program trunk.

If the buzzer timer register is full, the microprocessor will set the buzzer "on" switch, and then decrement the buzzer register, and following a 1 second delay, will determine whether the seconds register is odd. If it is not, the microprocessor will blank the display. If it is, the microprocessor will display the time.

Following either of the above two instructions, the microprocessor then determines whether the time frame equals 4 (i.e., the alarm time has been reached within the past hour). If it has, the microprocessor will ignite the LED (34) for 125 milliseconds every two seconds. The microprocessor will then proceed to the "read k inputs" sub-routine.

Operation

Figure 3A:
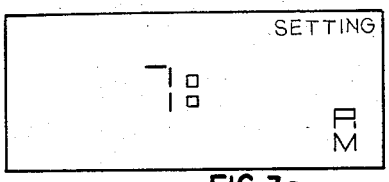
FIG. 3*a–n* depicts various display modes.
Figure 3B:
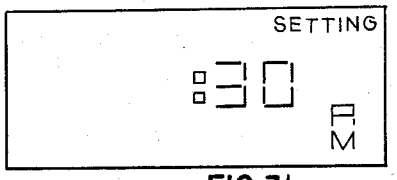
Figure 3C:
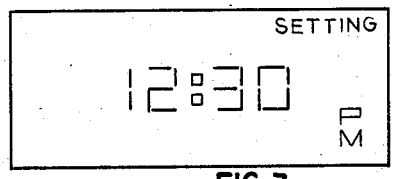
Figure 3D:
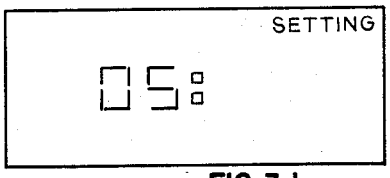
Figure 3E:
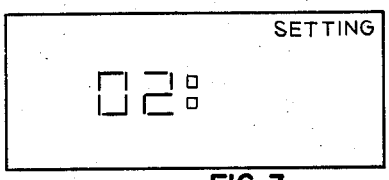
Figure 3F:
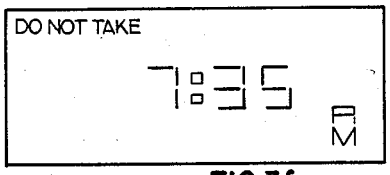
Figure 3G:
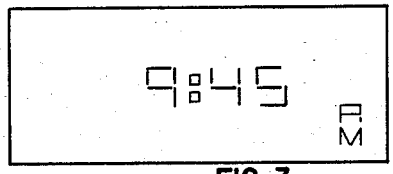
Figure 3H:
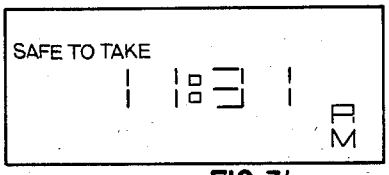
Figure 3I:
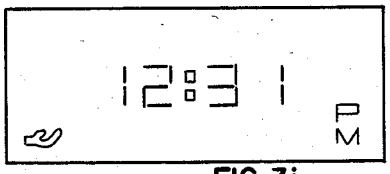
Figure 3J:
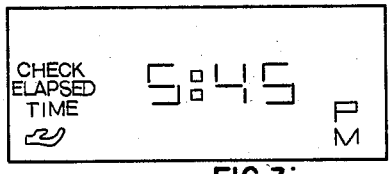
Figure 3K:
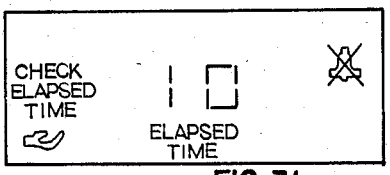
Figure 3L:
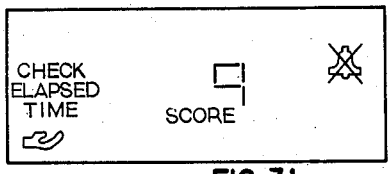
Figure 3M:
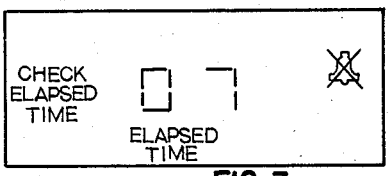
Figure 3N:
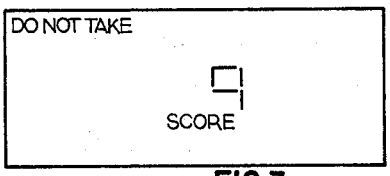

Referring now to FIGS. 3*a* through 3*n*, the general operation of the apparatus will be described.

Time may be set by placing the mode switch (27) in the hours set position. The display will begin by incrementing the hours shown at one second intervals when the squelch switch is closed. When the correct hour appears, the squelch switch (28) may be released.

Following this, the correct minutes may be set in a similar manner by placing the mode switch in the minutes set position. In the settings depicted in FIGS. 7*a* and 7*b*, the time of 7:30 a.m. has been so set.

Following this, the invention may be placed in an appropriate mode to set either an alarm time or alarm interval. If the alarm time mode has been chosen, the display will begin by depicting 6:00 a.m. The display will then increment ten minutes every one second. When an appropriate alarm time appears, such as 12:30 p.m. (see FIG. 3*c*), the squelch button (28) may be closed. This will cause the displayed time to be stored as an alarm time. Up to six discrete alarm times may be set in this manner.

If the interval alarm time is chosen instead, the display will increment in one hour intervals every second. When the appropriate interval appears on the display, the squelch button (28) may be closed to store this interval in memory. In the example depicted at FIG. 3*d*, an interval of five hours has been chosen.

With reference to FIG. 3*e*, the mode switch (27) can be set to store a minimum safe interval between dosages figure. When this mode has been chosen, the display again increments in one hour intervals each second. When the appropriate minimum safe interval between dosages appears on the display, the squelch button (28) may be closed to store this figure in memory. In the example depicted at FIG. 3*e*, a minimum safe interval between dosages of two hours has been set.

The invention will now operate in a normal time keeping and display mode (see FIG. 3*f*). At the time depicted of 7:35 a.m., the "do not take" signal flag (58) appears on the display unit (22) to indicate that the two hour minimum safe interval between dosages has not yet been exceeded.

The invention will continue to measure and display the time of day on the display unit in the normal operating mode. In the example depicted at FIG. 3*g*, the time of 9:45 a.m. has been reached. Therefore, two hours and fifteen minutes have passed since the invention began operating. Since the two hour minimum safe interval between dosages has been exceeded, the "do not take" signal flag (58) has been extinquished. Since neither the predosing interval nor the alarm time has been reached, no other signal flags are displayed.

In the example depicted at FIG. 3*h*, the time of day has reached 11:31 a.m. Therefore, only 59 minutes remain until the scheduled medication time of 12:30 p.m. (under either the alarm time of day mode (FIG. 3*c*) or the alarm interval mode (FIG. 3*d*)). Since less than one hour remains, the "1 hr. predose" signal flag (59) has been displayed to indicate that the predosing interval has arrived.

In the example depicted at FIG. 3*i*, the time of day has reached 12:31 p.m. (1 minute past the scheduled time for a dosage). Therefore, the predosing interval has been exceeded and the "1 hr. predose" signal flag (59) has been extinguished. In its place, the cup-shaped hand signal flag (62) appears. At the same time, the audible alarm begins to sound for three seconds every 256 seconds and the light emitting diode flashes for a brief moment every two seconds. In addition, the seven segment alpha numeric display flashes intermittently. The flashing of the light emitting diode will continue for up to one hour past the alarm time.

When in the time of day alarm mode, the audible alarm will continue to sound for three seconds at 256 second intervals until the second alarm time has been reached. At that time, the alarm will begin sounding for six seconds at 256 second intervals. In the interval mode, the audible alarm will sound at three second periods every 256 seconds until one hour past the initiation of the alarm period. Thereafter, the audible alarm will sound for six seconds every 256 seconds.

If the medication containment box associated with the invention is now opened, the compliance sensing unit (14) will sense this. The invention will then note that the medication was presumably dispensed at the appropriate time and the invention will begin anew the measurement of time until the next scheduled dispensation of medication. In addition, the next alarm time will be placed in a working register if in the alarm time of day mode. Otherwise, the measurement of the next interval will begin from the time of dispensation.

If medication is not dispensed, the compliance sensing unit (14) will sense this as well, and time will continue to be measured. In the example depicted at FIG. 3*j*, either the second alarm time has been reached (in the alarm time of day mode) or a full interval period since the expiration of the last interval has passed in the interval mode). The cup-shaped hand (62) continues to appear on the display unit (22) and the "check elapsed time" signal flag (61) appears as well. This is to warn the operator that a dosage has been missed. The patient may then act in accordance with his physician's instructions for such an occurrence.

With reference to FIG. 3*k*, so long as the squelch button (28) is closed, elapsed time since the last dispensation of medication (as monitored by the compliance sensing unit (14)) will be displayed, along with an "elapsed time" signal flag (62). When the squelch button (28) is again opened (see FIG. 31), the compliance score will be momentarily displayed along with the "score" signal flag (64).

If the squelch function has not already been made operable, then closing the squelch button (28) will also enable the squelch function and cause the squelch indicia signal flag (68) to be displayed. Conversely, if the squelch function has already been enabled, then closing the squelch button (28) will disable the squelch function and extinguish the squelch indicia signal flag (68).

Similarly, when the pill compartment is first opened, the display unit (22) will display elapsed time since the last opening of the pill compartment (see FIG. 3*m*). When the pill compartment is first closed, the display unit (22) will momentarily display the compliance score (see FIG. 3*n*).

Compliance can be monitored, recorded and communicated in a variety of ways. In the embodiment depicted, the compliance score will be automatically subtracted from after the 8 minute interval. Opening the pill compartment either before or after the period one hour either side of the scheduled dosage time will result in reducing the score by 1. The compliance score will be added back if the medication drawer is opened at any time during the safe predosage interval or within one hour following the scheduled dosage time. The compliance score is an indication of the number of times the medication has been administered within one hour of the scheduled time. The perfect score is 10.

By providing such a compliance score, any person, including the patient or the attending health care personnel, can easily inspect the score by manipulation of the squelch button (28) to determine how well a particular patient has been following his prescription schedule.

The squelch switch (28) allows an operator to inhibit the audible alarm function of the invention. This feature is separately provided so that a patient will not attempt to defeat the compliance sensing unit when attempting to squelch the audible alarm function. Nevertheless, if an additional one hour time interval exceeds an additional missed dosage, the squelch function will be inhibited and the audible alarm will begin sounding.

Also, an eight minute compliance sensing inhibitor comes into effect every time the medicine container is closed. More particularly, for eight minutes following a closure of the medicine container, the medicine container can be opened and closed without affecting the compliance score. This allows refilling of the medicine container or other such maintenance activities as might be appropriate.

Obviously, many modifications and variations of the present invention are possible in light of the above teachings. It is therefore to be understood that, within the scope of the appended claims, the invention may be practised otherwise than as specifically described.

I claim:

1. A medical timer device for use in protecting against inadvertent overdosage of at least one preselected medication, the device comprising:

(a) sensing means for sensing a preselected monitored parameter that evidences dispensation of such medication;

(b) input means for inputting a minimum safe interval between dosages;

(c) time measurement means operably connected to said sensing means for measuring the passage of time following a sensing of said preselected monitored parameter;

(d) comparison means for comparing said minimum safe interval between dosages with time as measured by said time measurement means; and (e) first display means operably connected to said comparison means for signalling when time as measured by said time measurement means does not exceed said minimum safe interval between dosages.

2. The device of claim 1 wherein said device may further be used in the periodic administration of said preselected medication, said device further comprising alarm means operably connected to said time measurement means for sounding an audible alarm signal when said medication should be administered.

3. The device of claim 2 and further comprising:

(a) missed dosage sensing means operably connected to said sensing means for determining when a plurality of scheduled medication administrations have passed without said sensing means having sensed said preselected monitored parameter; and (b) second display means operably connected to said missed dosage sensing means for signalling when a plurality of scheduled administrations have passed without said sensing means having sensed said preselected monitored parameter.

4. The device of claim 2 and further comprising:

(a) predosing interval means for determining when a preselected time interval or less exists until the next signal by said alarm means; and (b) second display means operably connected to said predosing interval means for signalling that it may be safe to administer said medication even though said alarm means has not yet signalled that such medication should be taken.

5. The device of claim 2 and further comprising an alarm set unit for controlling said alarm means, wherein an operator may select to input scheduled dosage information as between a first form and a second form; said first form comprising at least one preset time of day and said second form comprising a preset time interval following sensings of said preselected monitored parameter.

6. The device of claim 2 and further comprising compliance measuring means operably connected to said sensing means and to said time measurement means for monitoring and measuring compliance with a schedule of periodic administrations for said medication.

7. In a medical timer device for use in the periodic administration of at least one preselected medication, the device having sensing means for sensing a preselected monitored parameter that evidences dispensation of such medication and alarm means for sounding an audible alarm signal when the time for dispensation of such medication has arrived, an improvement comprising:

(a) missed dosage sensing means operably connected to said sensing means for determining when a plurality of scheduled medication administrations have passed without said sensing means having sensed said preselected monitored parameter; and (b) first display means operably connected to said missed dosage sensing means for signalling that a plurality of scheduled administrations have passed without said sensing means having sensed said preselected monitored parameter.

8. The improvement of claim 7 and further including:

(a) time measurement means operably connected to said sensing means for measuring elapsed time from each said sensing of said preselected monitored parameter; and (b) second display means operably connected to said time measurement means for selectively displaying said measured elapsed time.

9. The improvement of claim 8 wherein said first display means includes an indicia that said second display means should be consulted.

10. The improvement of claim 9 and further comprising:

(a) predosing interval means for determining when a preselected time interval or less exists until the next signal by said alarm means; and (b) third display means operatively connected to said predosing interval means for signalling that it may be safe to administer said medication even though said alarm means has not yet signalled that such medication should be taken.

11. The improvement of claim 9 and further comprising an alarm set unit for controlling said alarm means, wherein an operator may select to input scheduled dosage information as between a first form and a second form; said first form comprising at least one preset time of day and said second form comprising a preset time interval following sensings of said preselected monitored parameter.

12. The improvement of claim 9 and further comprising compliance measuring means operably connected to said sensing means and to said time measurement means for monitoring and measuring compliance with a schedule of periodic administration for said medication.

13. In a medical timer device for use in the periodic administration of at least one preselected medication, the device having sensing means for sensing a preselected monitored parameter that evidences dispensation of such medication, an improvement comprising:

(a) alarm means for signalling when said medication should be dispensed;

(b) predosing interval means for determining when a preselected time interval or less exists until the next signal by said alarm means; and (c) first display means operatively connected to said predosing interval means to provide a visually preceptible signal for signalling that it is safe to administer said medication prior to the next signal by said alarm means even though said alarm means has not yet signalled that such medication should be taken.

14. The improvement of claim 13 and further comprising an alarm set unit for controlling said alarm means, wherein an operator may select to input scheduled dosage information as between a first form and a second form; said first form comprising at least one preset time of day and said second form comprising a preset time interval following sensings of said preselected monitored parameter.

15. The improvement of claim 13 and further comprising compliance measuring means operably connected to said sensing means for monitoring and measuring compliance with a schedule of periodic administration for said medication.

16. In a medical timer and alarm apparatus for use in the scheduled periodic administration of at least one preselected medication, said apparatus having sensing means for sensing a preselected monitored parameter that evidences dispensation of such medication and time measurement means for measuring time, an improvement comprising:

(a) compliance measuring means operably connected to said sensing means and to said time measurement means for monitoring and measuring compliance with a schedule of periodic administration for said medication;

(b) input means for inputting a minimum safe interval between dosages;

(c) comparison means for comparing said minimum safe interval between dosages with time as measured by said time measurement means;

(d) first display means operably connected to said comparison means for signalling when time as measured by said time measurement means does not yet exceed said minimum safe interval between dosages;

(e) alarm means for sounding an audible alarm when said medication should be dispensed;

(f) missed dosage sensing means operably connected to said sensing means and to said alarm means for determining when a plurality of scheduled medication administrations have passed without said sensing means having sensed said preselected monitored parameter;

(g) second display means operably connected to said missed dosage sensing means for signalling when a plurality of scheduled administrations have passed without said sensing means having sensed said preselected monitored parameter;

(h) third display means operably connected to said time measurement means for selectively displaying said measured elapsed time;

(i) predosing interval means for determining when a preselected time interval or less exists until the next signal by said alarm means;

(j) fourth display means operatively connected to said predosing interval means for signalling that it may be safe to administer said medication even though said alarm means has not yet signalled that said medication should be taken; and (k) an alarm set unit for controlling said alarm means wherein an operator may select to input scheduled dosage information as between a first form and a second form; said first form comprising at least one preset time of day and said second form comprising a preset time interval following sensing of said preselected monitored parameter.

* * * * *